US008593280B2

(12) United States Patent
Tan et al.

(10) Patent No.: US 8,593,280 B2
(45) Date of Patent: Nov. 26, 2013

(54) SECURITY SEAL

(75) Inventors: Chin Tong Tan, Ipoh (MY); Timothy Dirk Stevens, Boulder, CO (US); Gary Nunes, San Jose, CA (US)

(73) Assignees: Savi Technology, Inc., Alexandria, VA (US); Deal Magic, Inc., Edmonds, WA (US); Envotek Network SDN BHD (657306-W), Ipoh (MY)

( * ) Notice: Subject to any disclaimer, the term of this patent is extended or adjusted under 35 U.S.C. 154(b) by 514 days.

(21) Appl. No.: 12/836,209

(22) Filed: Jul. 14, 2010

(65) Prior Publication Data

US 2011/0133932 A1 Jun. 9, 2011

Related U.S. Application Data

(60) Provisional application No. 61/225,508, filed on Jul. 14, 2009, provisional application No. 61/263,794, filed on Nov. 23, 2009.

(51) Int. Cl.
*G08B 13/14* (2006.01)

(52) U.S. Cl.
USPC ..... 340/568.1; 340/686.1; 340/541

(58) Field of Classification Search
USPC ..... 340/568.1, 539.13, 568.2, 539.1, 340/539.22, 426.19, 426.1, 541, 545.1, 340/686.1
See application file for complete search history.

(56) References Cited

U.S. PATENT DOCUMENTS

| | | | |
|---|---|---|---|
| 690,191 | A | 12/1901 | Saxe |
| 3,688,256 | A | 8/1972 | D'Ausilio et al. |
| 3,848,243 | A | 11/1974 | Schirmer |
| 3,961,323 | A | 6/1976 | Hartkorn |
| 3,993,987 | A | 11/1976 | Stevens |
| 4,118,057 | A | 10/1978 | Ryan |
| 4,233,595 | A | 11/1980 | Landkammer |
| 4,262,284 | A | 4/1981 | Stieff et al. |
| 4,300,057 | A | 11/1981 | Crosas |
| 4,523,186 | A | 6/1985 | Fiarman |
| 4,556,872 | A | 12/1985 | Masoncup et al. |
| 4,627,248 | A | 12/1986 | Haworth |
| 4,699,408 | A | 10/1987 | Kesselman |
| 4,729,626 | A | 3/1988 | Stieff |
| 4,736,857 | A | 4/1988 | Monico, Jr. et al. |
| 4,768,816 | A | 9/1988 | Bakula |

(Continued)

FOREIGN PATENT DOCUMENTS

| | | | |
|---|---|---|---|
| CN | 1989513 | A | 6/2007 |
| CN | 101251886 | A | 8/2008 |
| EP | 0 516 611 | | 12/1992 |
| GB | 2 368 174 | A | 4/2002 |

(Continued)

OTHER PUBLICATIONS

International Search Report and Written Opinion of the International Searching Authority, PCT Application Serial No. PCT/US2010/041994, Sep. 14, 2010, 12 pp.

(Continued)

*Primary Examiner* — Daniel Previl
(74) *Attorney, Agent, or Firm* — Fish & Richardson P.C.

(57) ABSTRACT

A security electronic seal is described. The electronic seal uses a first shaft to lock an asset, and a second inexpensive consumable shaft to lock the first shaft. These shafts provide an electronic means of monitoring the security of the seal. The seal can detect tampering of the asset secured by the device, and in some implementations provides a wireless notification.

57 Claims, 22 Drawing Sheets

(56) References Cited

U.S. PATENT DOCUMENTS 4,802,700 A 2/1989 Stevenson et al.
4,811,977 A 3/1989 Swift et al.
4,816,822 A 3/1989 Vache et al.
4,924,210 A 5/1990 Matsui et al.
4,946,210 A 8/1990 Fuehrer
4,990,890 A 2/1991 Newby et al.
4,992,789 A 2/1991 Czerwinski
5,005,883 A 4/1991 Guiler
5,021,610 A 6/1991 Roberts
5,099,228 A 3/1992 Israel et al.
5,103,207 A 4/1992 Kerr et al.
5,120,097 A 6/1992 Fattori et al.
5,126,746 A 6/1992 Gritton
5,151,684 A 9/1992 Johnsen
5,189,396 A 2/1993 Stobbe et al.
5,247,564 A 9/1993 Zicker
5,258,741 A 11/1993 Fuller
5,266,925 A 11/1993 Vercellorri
5,284,036 A 2/1994 Rosenbaum
5,298,884 A 3/1994 Gilmore et al.
5,302,954 A 4/1994 Brooks et al.
5,406,263 A 4/1995 Tuttle
5,427,423 A 6/1995 Georgopoulos
5,483,666 A 1/1996 Yamada et al.
5,491,486 A 2/1996 Welles et al.
5,515,030 A 5/1996 Citron et al.
5,525,992 A 6/1996 Froschermeier
5,541,604 A 7/1996 Meier
5,565,858 A 10/1996 Guthrie
5,587,702 A 12/1996 Chadfield
5,615,247 A 3/1997 Mills
5,656,996 A 8/1997 Houser
5,710,973 A 1/1998 Yamada et al.
5,727,405 A 3/1998 Cromwell
5,752,218 A 5/1998 Harrison et al.
5,758,263 A 5/1998 Berger et al.
5,774,876 A 6/1998 Woolley et al.
5,798,460 A 8/1998 Nakagawa et al.
5,815,407 A 9/1998 Huffman et al.
5,819,569 A 10/1998 Herdman
5,827,965 A 10/1998 Nakagawa et al.
5,836,002 A 11/1998 Morstein et al.
5,861,810 A 1/1999 Nguyen
5,946,350 A 8/1999 Uesugi
5,959,529 A 9/1999 Kail, IV
6,026,690 A 2/2000 Nakagawa et al.
6,069,563 A 5/2000 Kadner et al.
6,075,443 A 6/2000 Schepps et al.
6,243,005 B1 6/2001 Haimovich et al.
6,249,252 B1 6/2001 Dupray
6,265,973 B1 7/2001 Brammall et al.
6,292,108 B1 9/2001 Straser et al.
6,420,971 B1 7/2002 Leck et al.
6,496,766 B1 12/2002 Bernold et al.
6,529,131 B2 3/2003 Wentworth
6,571,213 B1 5/2003 Altendahl et al.
6,727,817 B2 4/2004 Maloney
6,736,768 B2 * 5/2004 Felt et al. ..... 494/60
6,753,775 B2 6/2004 Auerbach et al.
6,778,083 B2 * 8/2004 Auerbach et al. ..... 340/539.1
6,792,353 B2 9/2004 Lin
6,879,962 B1 4/2005 Smith et al.
6,927,688 B2 8/2005 Tice
6,965,313 B1 11/2005 Saylor et al.
6,972,682 B2 12/2005 Lareau et al.
6,990,335 B1 1/2006 Shamoon et al.
7,035,856 B1 4/2006 Morimoto
7,044,374 B2 5/2006 Allison et al.
7,049,963 B2 5/2006 Waterhouse et al.
7,072,668 B2 7/2006 Chou
7,098,784 B2 8/2006 Easley et al.
7,106,244 B2 9/2006 Hsu
7,113,090 B1 9/2006 Saylor et al.
7,136,830 B1 11/2006 Kuelbs et al.
7,136,832 B2 11/2006 Li et al.
7,164,986 B2 1/2007 Humphries et al.
7,193,557 B1 3/2007 Kovacich et al.
7,196,621 B2 3/2007 Kochis
7,212,829 B1 5/2007 Lau et al.
7,239,238 B2 7/2007 Tester et al.
7,257,397 B2 8/2007 Shamoon et al.
7,274,332 B1 9/2007 Dupray
7,275,651 B2 10/2007 Morales et al.
7,286,683 B2 10/2007 Hadell
7,298,327 B2 11/2007 Dupray et al.
7,312,752 B2 12/2007 Smith et al.
7,315,281 B2 1/2008 Dejanovic et al.
7,336,152 B2 2/2008 Horwitz et al.
7,336,170 B2 2/2008 Auerbach et al.
7,339,469 B2 * 3/2008 Braun ..... 340/539.13
7,350,383 B1 4/2008 Kuo
7,382,251 B2 6/2008 Bohman et al.
7,385,500 B2 6/2008 Irwin
7,385,529 B2 6/2008 Hersh et al.
7,391,321 B2 6/2008 Twitchell, Jr.
7,394,361 B1 7/2008 Twitchell, Jr.
7,423,535 B2 9/2008 Chung et al.
7,467,032 B2 12/2008 Kane et al.
7,471,203 B2 12/2008 Worthy et al.
7,482,920 B2 1/2009 Joao
RE40,642 E 2/2009 Harrison et al.
7,498,938 B2 3/2009 Ulrich
7,499,997 B2 3/2009 Hancock et al.
7,525,484 B2 4/2009 Dupray et al.
7,536,321 B2 5/2009 Takahashi et al.
7,616,116 B2 11/2009 Ehrensvard et al.
7,623,033 B2 11/2009 Ainsworth et al.
7,639,131 B2 12/2009 Mock et al.
7,643,823 B2 1/2010 Shamoon et al.
7,652,576 B1 1/2010 Crossno et al.
7,657,468 B1 2/2010 Whiteley et al.
7,668,532 B2 2/2010 Shamoon et al.
7,688,207 B2 3/2010 Fritchie et al.
7,707,076 B1 4/2010 Whiteley et al.
7,714,778 B2 5/2010 Dupray
7,724,138 B2 5/2010 Horwitz et al.
7,746,228 B2 6/2010 Sensenig et al.
7,760,103 B2 7/2010 Frank
7,764,231 B1 7/2010 Karr et al.
7,822,580 B2 10/2010 Mustonen
7,830,852 B2 11/2010 Twitchell, Jr.
7,853,480 B2 12/2010 Taylor et al.
7,864,061 B2 1/2011 Frank
7,903,029 B2 3/2011 Dupray
7,936,266 B2 5/2011 Francis et al.
7,937,244 B2 5/2011 Kadaba
7,973,536 B2 7/2011 Kojovic et al.
7,986,238 B2 7/2011 Cho
7,990,270 B2 8/2011 Mostov
7,990,947 B2 8/2011 Twitchell et al.
8,032,153 B2 10/2011 Dupray et al.
8,064,935 B2 11/2011 Shamoon et al.
8,068,023 B2 11/2011 Dulin et al.
8,082,094 B2 12/2011 Gao
8,082,096 B2 12/2011 Dupray
8,135,413 B2 3/2012 Dupray
8,164,458 B2 4/2012 Mostov
8,217,785 B2 7/2012 Steer
8,228,192 B2 7/2012 Eckert et al.
2001/0022558 A1 9/2001 Karr et al.
2002/0100300 A1 * 8/2002 Reeb et al. ..... 70/201
2002/0104013 A1 8/2002 Ghazarian
2002/0111819 A1 8/2002 Li et al.
2002/0113704 A1 * 8/2002 Hess ..... 340/568.2
2003/0126024 A1 7/2003 Crampton et al.
2003/0137968 A1 7/2003 Lareau et al.
2003/0146871 A1 8/2003 Karr et al.
2003/0171948 A1 9/2003 Thomas et al.
2003/0195791 A1 10/2003 Waller et al.
2003/0222820 A1 12/2003 Karr et al.
2003/0227392 A1 12/2003 Ebert et al.
2003/0233189 A1 12/2003 Hsiao et al.
2004/0100379 A1 5/2004 Boman et al.
2004/0113783 A1 6/2004 Yagesh

(56) References Cited

U.S. PATENT DOCUMENTS

2004/0113933 A1 6/2004 Guler
2004/0124977 A1 7/2004 Biffar
2004/0126015 A1 7/2004 Hadell
2004/0183673 A1 9/2004 Nageli
2004/0193466 A1 9/2004 Kull et al.
2004/0198386 A1 10/2004 Dupray
2004/0199411 A1 10/2004 Bertram et al.
2004/0202154 A1 10/2004 Aklepi et al.
2004/0227630 A1 11/2004 Shannon et al.
2004/0246130 A1 12/2004 Lambright et al.
2004/0257225 A1 12/2004 Webb, Sr. et al.
2004/0266457 A1 12/2004 Dupray
2005/0055237 A1 3/2005 Schmidtberg et al.
2005/0091091 A1 4/2005 Bjerre et al.
2005/0156736 A1 7/2005 Rajapakse et al.
2005/0159883 A1 7/2005 Humphries et al.
2005/0190097 A1 9/2005 Hsu
2005/0219037 A1 10/2005 Huang et al.
2005/0248454 A1 11/2005 Hanson et al.
2005/0256731 A1 11/2005 Mougey et al.
2006/0047379 A1 3/2006 Schullian et al.
2006/0054705 A1 3/2006 Garton et al.
2006/0101897 A1 5/2006 Masuya et al.
2006/0105760 A1 5/2006 Shamoon et al.
2006/0109109 A1 5/2006 Rajapakse et al.
2006/0116893 A1 6/2006 Carnes et al.
2006/0123766 A1* 6/2006 Wassenhoven ..... 57/408
2006/0145837 A1 7/2006 Horton et al.
2006/0155591 A1 7/2006 Altaf et al.
2006/0202824 A1 9/2006 Carroll et al.
2006/0229895 A1 10/2006 Kodger
2006/0232398 A1 10/2006 Nedblake et al.
2006/0238332 A1 10/2006 Carle et al.
2006/0255934 A1 11/2006 Easley et al.
2006/0276201 A1 12/2006 Dupray
2006/0288744 A1 12/2006 Smith
2007/0043538 A1 2/2007 Johnson et al.
2007/0046459 A1 3/2007 Silverman et al.
2007/0056369 A1 3/2007 Griffin et al.
2007/0115902 A1 5/2007 Shamoon et al.
2007/0120381 A1 5/2007 Ehrensvard et al.
2007/0145130 A1 6/2007 Danilewitz
2007/0150379 A1 6/2007 Vernaci et al.
2007/0155379 A1 7/2007 Shamoon et al.
2007/0167179 A1 7/2007 Shamoon et al.
2007/0182556 A1 8/2007 Rado et al.
2007/0222232 A1 9/2007 Held
2007/0222674 A1 9/2007 Tan et al.
2007/0247366 A1 10/2007 Smith et al.
2007/0252696 A1 11/2007 Belisle et al.
2007/0262861 A1 11/2007 Anderson et al.
2007/0285232 A1 12/2007 Bohman et al.
2007/0287473 A1 12/2007 Dupray
2008/0006696 A1 1/2008 Piersol et al.
2008/0040244 A1 2/2008 Ricciuti et al.
2008/0041124 A1 2/2008 Rudd
2008/0042809 A1 2/2008 Watts et al.
2008/0086391 A1 4/2008 Maynard et al.
2008/0094209 A1 4/2008 Braun et al.
2008/0111693 A1 5/2008 Johnson et al.
2008/0113672 A1 5/2008 Karr et al.
2008/0133126 A1 6/2008 Dupray
2008/0143516 A1 6/2008 Mock et al.
2008/0143604 A1 6/2008 Mock et al.
2008/0150698 A1 6/2008 Smith et al.
2008/0157974 A1 7/2008 Boss et al.
2008/0167049 A1 7/2008 Karr et al.
2008/0186166 A1 8/2008 Zhou et al.
2008/0224875 A1 9/2008 Phillips et al.
2008/0231459 A1 9/2008 Corder
2008/0248813 A1 10/2008 Chatterjee et al.
2008/0252428 A1 10/2008 Robinson et al.
2008/0281618 A1 11/2008 Mermet et al.
2008/0309487 A1 12/2008 Chao
2009/0030715 A1 1/2009 Robb et al.
2009/0060349 A1 3/2009 Linaker et al.
2009/0083123 A1 3/2009 Powell et al.
2009/0102657 A1 4/2009 Evans et al.
2009/0102660 A1 4/2009 Evans et al.
2009/0121877 A1 5/2009 Henderson
2009/0134999 A1 5/2009 Dobson et al.
2009/0135000 A1 5/2009 Twitchell, Jr.
2009/0135015 A1 5/2009 Dobson et al.
2009/0140886 A1 6/2009 Bender
2009/0146805 A1 6/2009 Joao
2009/0146832 A1 6/2009 Ebert et al.
2009/0167536 A1 7/2009 Clark et al.
2009/0177394 A1 7/2009 Walz et al.
2009/0201169 A1 8/2009 d'Hont et al.
2009/0216775 A1 8/2009 Ratliff et al.
2009/0234493 A1 9/2009 Pandit et al.
2009/0308000 A1 12/2009 Corcoran
2009/0316682 A1 12/2009 Twitchell et al.
2009/0322510 A1 12/2009 Berger et al.
2009/0326971 A1 12/2009 Piccinini et al.
2010/0012653 A1 1/2010 Ulrich et al.
2010/0039284 A1 2/2010 Hall et al.
2010/0045436 A1 2/2010 Rinkes
2010/0066501 A1 3/2010 Ulrich et al.
2010/0066561 A1 3/2010 Ulrich et al.
2010/0073229 A1 3/2010 Pattabiraman et al.
2010/0076902 A1 3/2010 Kraft
2010/0090822 A1 4/2010 Benson et al.
2010/0095864 A1 4/2010 Forbes
2010/0102964 A1 4/2010 Steer
2010/0116932 A1 5/2010 Helou, Jr.
2010/0141393 A1 6/2010 Daniel
2010/0141445 A1 6/2010 Venkatasubramaniyam et al.
2010/0145739 A1 6/2010 Erhart et al.
2010/0234045 A1 9/2010 Karr et al.
2010/0238032 A1 9/2010 Greene
2010/0277280 A1 11/2010 Burkart et al.
2010/0312715 A1 12/2010 Esque et al.
2011/0012731 A1 1/2011 Stevens
2011/0025496 A1 2/2011 Cova et al.
2011/0046775 A1 2/2011 Bailey et al.
2011/0050397 A1 3/2011 Cova
2011/0050423 A1 3/2011 Cova et al.
2011/0050424 A1 3/2011 Cova et al.
2011/0054979 A1 3/2011 Cova et al.
2011/0120199 A1 5/2011 Auerbach et al.
2011/0128143 A1 6/2011 Daniel
2011/0133888 A1 6/2011 Stevens et al.
2011/0258930 A1 10/2011 Francis et al.
2011/0266338 A1 11/2011 Babcock et al.
2011/0283750 A1 11/2011 Will
2011/0289320 A1 11/2011 Twitchell et al.
2012/0009872 A1 1/2012 Lane et al.
2012/0058775 A1 3/2012 Dupray et al.
2012/0069131 A1 3/2012 Abelow
2012/0094638 A1 4/2012 Shamoon et al.
2012/0182180 A1 7/2012 Wolf et al.
2012/0190380 A1 7/2012 Dupray et al.
2012/0303498 A1 11/2012 Cova et al.
2012/0310854 A1 12/2012 Cova et al.

FOREIGN PATENT DOCUMENTS

GB 2 448 482 A 10/2008
NZ 541176 A 8/2005
WO WO 03/098175 11/2003
WO WO2006053566 A1 5/2006
WO WO 2007/121508 11/2007
WO WO 2010/077688 7/2010
WO WO 2011/008884 1/2011
WO WO 2011/014708 2/2011
WO WO 2011/022412 2/2011
WO WO 2011/025821 3/2011
WO WO 2011/025829 3/2011
WO WO 2011/025987 3/2011

OTHER PUBLICATIONS

U.S. Appl. No. 13/569,862, filed Aug. 8, 2012, Cova et al.

(56) References Cited

OTHER PUBLICATIONS

U.S. Appl. No. 13/569,884, filed Aug. 8, 2012, Cova et al.
International Preliminary Report on Patentability, PCT Application Serial No. PCT/US2010/041994 filed Jul. 14, 2010, received Jan. 17, 2012, 11 pp.
International Preliminary Report on Patentability, PCT Application Serial No. PCT/US2009/067210, received Jun. 23, 2011, 8 pp.
International Preliminary Report on Patentability, PCT Application Serial No. PCT/US2010/047042 filed Aug. 27, 2010, received Feb. 28, 2012, 8 pp.
International Preliminary Report on Patentability, PCT Application Serial No. PCT/US2010/043795 filed Jul. 29, 2010, received Jan. 31, 2012, 9 pp.
International Preliminary Report on Patentability, PCT Application Serial No. PCT/US2010/045776 filed Aug. 17, 2010, received Feb. 21, 2012, 9 pp.
International Preliminary Report on Patentability, PCT Application Serial No. PCT/US2010/046655, mailed Mar. 8, 2012, 8 pp.
International Preliminary Report on Patentability, PCT Application Serial No. PCT/US2010/046640 filed Aug. 25, 2010, mailed Mar. 6, 2012, 8 pp.
International Search Report and Written Opinion of the International Searching Authority, PCT Application Serial No. PCT/US2009/067210, received Feb. 4, 2010, 9 pp.
International Search Report and Written Opinion of the International Searching Authority, PCT Application Serial No. PCT/US2010/047042 filed Aug. 27, 2010, received Dec. 27, 2010, 11 pp.
International Search Report and Written Opinion of the International Searching Authority, PCT Application Serial No. PCT/US2010/043795 filed Jul. 29, 2010, received Sep. 17, 2010, 11 pp.
International Search Report and Written Opinion of the International Searching Authority, PCT Application Serial No. PCT/US2010/045776 filed Aug. 17, 2010, received Oct. 8, 2010, 14 pp.
International Search Report and Written Opinion of the International Searching Authority, PCT Application Serial No. PCT/US2010/042014 filed Jul. 14, 2010, Received Sep. 14, 2010, 8 pp.
International Search Report and Written Opinion of the International Searching Authority, PCT Application Serial No. PCT/US2010/046655, mailed Oct. 20, 2010, 9 pp.
International Search Report and Written Opinion of the International Searching Authority, PCT Application Serial No. PCT/US2010/046640 filed Aug. 25, 2010, mailed Oct. 18, 2010, 9 pp.
InternationaPreliminary Report on Patentability, PCT Application Serial No. PCT/US2010/042014 filed Jul. 14, 2010, Received Jan. 17, 2012, 7 pp.
"Hercules Zigbee e-Seal Bolt". Bolt eSeal Electronic Seals—TydenBrooks. Retrieved from the internet: URL<URL: http://www.tydenbrooks.com/Products/Electronic-Seals/Bolt-eSeal.aspx>, Aug. 2, 2012. 2 pages.
Bajikar, Sundeep. "Trusted Platform Module (TPM) based Security on Notebook PCs—White Paper", Jun. 20, 2002, Mobile Platforms Group, Intel Corporation. Retrieved from the internet: URL <http://www.intel.com/design/mobile/platform/downloads/Trusted+Platform+Module+White+Paper. pdf>, Aug. 2, 2012. 20 pages.
Chin, Le-Pong, et al. "The Role of Electronic Container Seal (E-Seal) with RFID Technology in the Container Security Initiatives." Proceedings of the International Conference on MEMS, NANO and Smart Systems 2004. ICMENS. Aug. 25-27, 2004. pp. 116-120.
FAQ, Trusted Computing group—Developers. Retrieved from the Internet: URL<http://www.trustedcomputinggroup.org/faq/TPMFAQ/>, Oct. 19, 2010. 2 pages.
GlobalTrak, "GlobalTrak+ Asset Monitoring Unit," 2 pages.
Liaw, M. and Cova, N., "Data Quality Delivered," A Savi Networks White Paper, copyright 2006, 19 pages.
Maersk Line, "Maersk Line Shipping Containers Worldwide". Retrieved from internet: URL<http://www.maerskline.com/link/?page=brochure&path=/our_services/our_e-commerce_services/maerskline.com/the_shipping_process/tracking>, dated Aug. 19, 2009. 7 pages.
Reid Simmons et al., "Learning to Predict Driver Route and Destination Intent" , Sep. 17-20, 2006, Proceedings of the 2006 IEEE Intelligent Transportation System Conference, pp. 127-132.
Siror, Joseph, et al. "Impact of RFID Technology on Tracking of Export Goods in Kenya." From Journal of Convergence Information Technology, vol. 5, No. 9. Nov. 2010. pp. 190-200.
U.S. Appl. No. 13/655,202, filed Oct. 18, 2012, 23 pages.
European Search Report; Dec. 3, 2012; European Patent Office (EPO); 10800498.7; 3 pages.
GlobalTrak, "GlobalTrak+ Asset Monitoring Unit." GlobalTrak Product Brochure/Datasheet. Published Pre—Oct. 1, 2009. 2 pages.
Arning, F. et al. *Vacoss 3, A Versatile and Tamper-Resistant Electronic Sealing System*. Journal of the Institute of Nuclear Materials Management, Nuclear Materials Management Proceedings Issue vol. X 22nd Annual Meeting, vol. 10, pp. 360-364, Jul. 1981.
Kupperman, D. et al. *Ceramic Tamper-Revealing Seals*. Department of Energy, Argonne National Lab., IL., 12 pages, Jan. 1991.
Martinez, R. et al. *New Design of the VACOSS-S/MIVS Interface System*. Department of Energy, Sandia National Labs., Albuquerque, NM., 14 pages, 1991.
Written Opinion by Hungarian Intellectual Property Office; Dec. 6, 2012; Singapore; 201201127-6; 7 pages.

* cited by examiner

SECURITY SEAL

CROSS-REFERENCE TO RELATED APPLICATIONS

This application claims priority to U.S. Provisional Application Ser. No. 61/225,508, filed Jul. 14, 2009, and U.S. Provisional Application Ser. No. 61/263,794, filed Nov. 23, 2009. The disclosure of each prior application is considered part of and is incorporated by reference in the disclosure of this application.

TECHNICAL FIELD

Security devices for securing physical goods are described.

BACKGROUND

Today's market relies heavily on shipping goods all over the globe. Goods are shipped over sea, as well as over land and air, potentially passing through a variety of ports or stops along their way. The goods are transported intermodally, such as by ship, truck, and airplane. The shippers, carriers and receivers need to be sure that the product that is being shipped is safe from theft, tampering and contamination. Government agencies and insurance companies also are interested in ensuring that the cargo that is sent is received safely. To better be able to detect or track the occurrence of unauthorized or illegal activity, the goods can be secured and their movement through the supply chain tracked. However, various securing and tracking methods can be vulnerable to bypass or may fail to provide the information that is necessary to give a complete picture of the location, treatment and security of the goods while in transit.

SUMMARY

An electronic security seal (e-Seal) is disclosed. The e-Seal can monitor the security of intermodal containers, and report tampers in real-time. The security monitoring complies with the ISO 17712 international standard for container security seals, adding electronic real-time reporting of tamper time and location as well as LED tamper indication to thwart undetected tampering. These security features greatly enhance the ability to decide the need to inspect a container mid-journey.

Advantages of the devices and techniques described herein can include one or more of the following. When a vertical shaft is inserted into a securing device, the vertical shaft can be held in place without a user having to hold the device in place. Therefore, the user can easily lock the device onto a container without needing an extra pair of hands. The device can be used in a variety of ways, such as to secure shipping containers that are shipped by ship or truck, secure large equipment, such as construction equipment, secure goods enclosed in an enclosure, such as under a canvas, secure goods that are not necessarily moving, or generally to secure valuable good. Sensitive electronics within the device are protected from the elements. A series of baffles can allow any water that accumulates within the device to be collected and drained out from within the device. The fastenerless housing cannot be breached by simply removing a fastener. Physical tampering or breaching of the device can be observed. Consumable components of the device are relatively inexpensive. When an authorized person breaks the component that prevents access to the information stored by the device, replacing the components is therefore inexpensive. The device enables immediate notification of tampering or compromise of the device or goods secured by the device. Thus, while the device does not prevent all types of tampering with the goods or breach of the device, it is an indicative type device and provides a way of tracking where tampering or breach occurs. The device can determine whether an actual compromise of the device has occurred, rather than when a mere environmental shock has produced a false detection of tampering. The device can track the location of the goods as they move from one geographic region to the next. If tampering occurs, the location of the tampering may be determined from information on the device. Thus, in the event of tampering, insurance claims can be processed and paid out more quickly. The device can provide a higher level of security for valuable goods.

The details of one or more implementations of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Goods can be secured, e.g., within a container, using a device that both cannot be opened without the opening being visibly or electronically detected and that is able to track the position of the device when device breach occurs. The tracking can be performed by a global positioning system (GPS). One or more authorized entities can remotely obtain access to information obtained by the device electronics, such as receiving wireless transmissions from the device. However, the information may only be obtained by the authorized entities, or by unauthorized entities, using a wired communicator when a locking mechanism is released or the system is broken into. Such tampering is visibly and electronically discernible. Locking mechanisms described herein detect each time the device is accessed and thus only allow for authorized persons to obtain, modify or reset the data using a wired communicator without setting off any tampering alerts.

Figure 1:
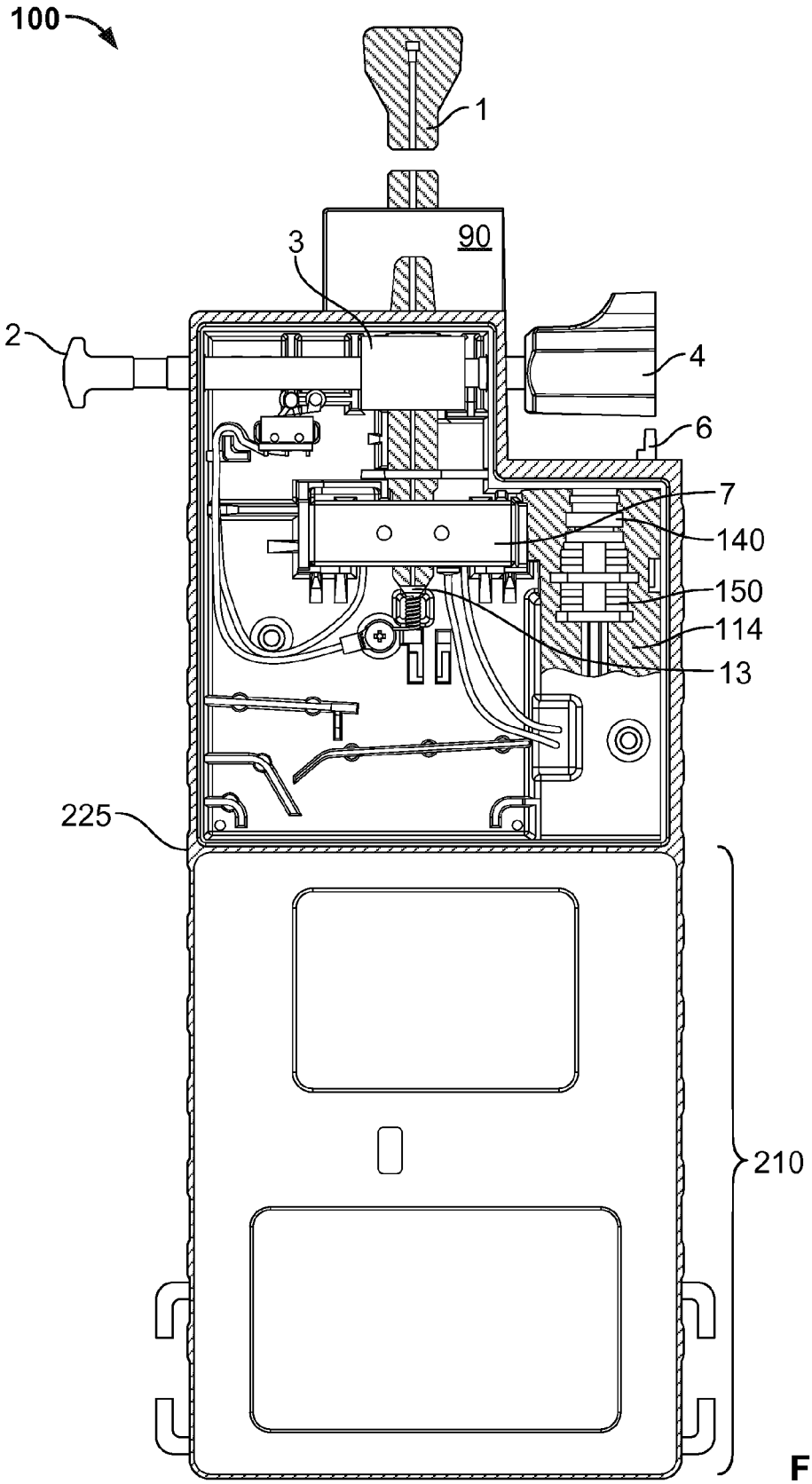
FIG. 1 is a plan view of the device with the locking compartment exposed.

Referring to FIG. 1, a device 100 for high security locking includes both mechanical and electrical means for ensuring that the device 100 is not opened by others than those authorized to do so. A locking compartment 110 houses the mechanical and electrical portions of the locking mechanisms. Inside of the locking compartment 110 is a cross block 3 that holds a vertical shaft 1 and a horizontal shaft 2. The vertical shaft 1 and horizontal shaft 2 are also referred to as a first shaft and a second shaft, respectively. The directions of the shafts are relative and not determinative, e.g., the two shafts can be perpendicular, but need not have any particular orientation with respect to gravity. The vertical shaft 1 and horizontal shaft 2 can each be rectilinear, solid, and rigid, that is, not easily bendable by a human without a tool. The vertical shaft 1 and horizontal shaft 2 both extend from outside of the locking compartment 110 into the interior of the locking compartment 110. The horizontal shaft 2 performs the locking function and in some uses extends through apertures, e.g., on a container. In some implementations, the horizontal shaft 2 is inserted into one or more holes on a lock of a container. A large end, e.g., a head, of the horizontal shaft 2 and a housing 225 in which the shaft is locked prevent the shaft from sliding all the way through holes on the container (see, e.g., FIG. 16). In some implementations, both ends of the horizontal shaft 2 extend outside of the locking compartment 110. When the locking compartment 110 is closed and the horizontal shaft 2 is in place, the vertical shaft 1 cannot be removed from the device 100 without breaking some component of the device.

As described further herein, the vertical shaft 1 is part of an electrical circuit, e.g., an electrical loop, that is housed in the locking compartment 110. The vertical shaft 1 makes electrical contact with a component of the circuit inside the locking compartment 110. Once the vertical shaft 1 is moved or the shaft 1 is cut, the electrical connection between the vertical shaft 1 and the component is broken, thereby opening the electrical circuit. The short causes the device to determine that a breach has occurred.

Figure 2:
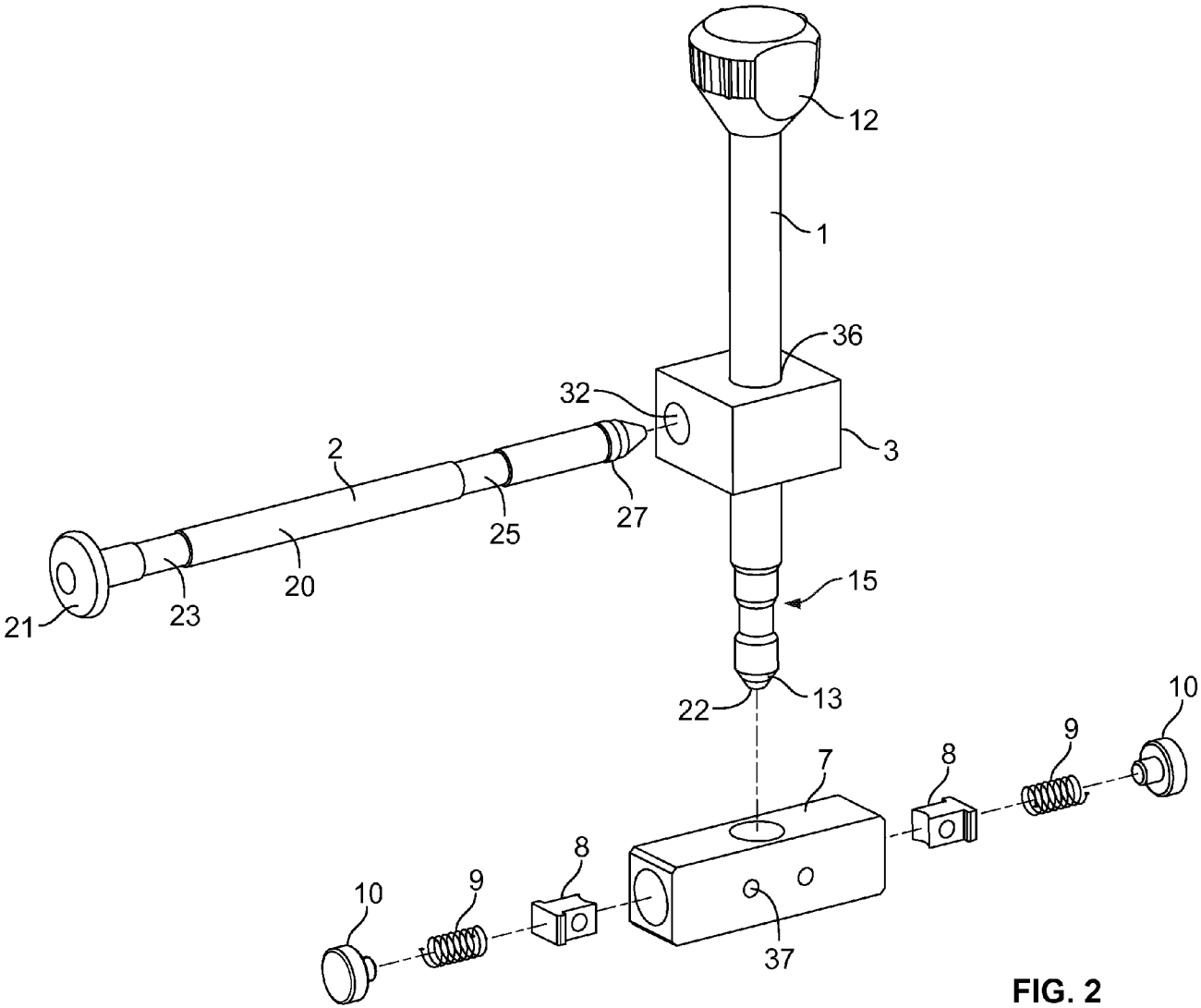
FIG. 2 is an exploded view of part of the cross locking mechanism.

Referring to FIG. 2, the cross block 3 has two apertures 32, 36, which each extend all the way through the cross block 3. The apertures 32, 36 are each configured to hold the vertical and horizontal shafts 1, 2, respectively. In some implementations, one or both of the apertures is a cylindrical aperture, although the apertures can have a different shape to them, such as rectangular, oval, elliptical or a polygonal. The two apertures are open to one another within the cross block 3. The apertures are open to one another so that the vertical shaft 1 can be placed in the cross block 3 first and the horizontal shaft 2 inserted after the vertical shaft 1 and the vertical shaft does not prevent the horizontal shaft from be placed through the cross block 3. Once the horizontal shaft 2 is in the block 3, however, the vertical shaft 1 cannot be removed from the block 3. There is a groove in the vertical shaft 1 (described further below) and the horizontal shaft sits in the groove so that the horizontal shaft 1 is held in the cross block 3 by the vertical shaft 2. In some implementations, both of the apertures 32, 36 are offset from a center of the cross block 3. The cross block 3 can be a rectangular block, although the shape of the block can be any other shape, so long as the block 3 fits into the appropriate location with in the locking compartment 110. The cross block 3 can be formed of a durable material, such as a metal, e.g., steel or aluminum, a ceramic or even a plastic.

Figure 2A:
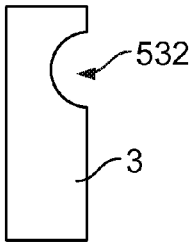
FIG. 2A is a side view of the cross locking mechanism.
Figure 2B:
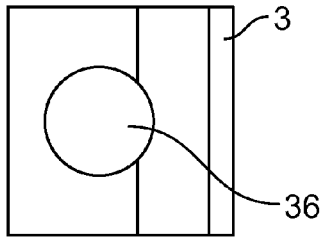
FIG. 2B is a plan view of the cross locking mechanism.
Figure 2C:
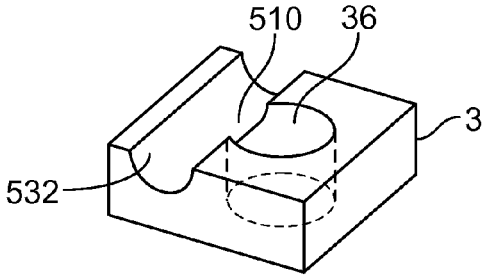
FIG. 2C is a perspective view of the cross locking mechanism.
Figure 2D:
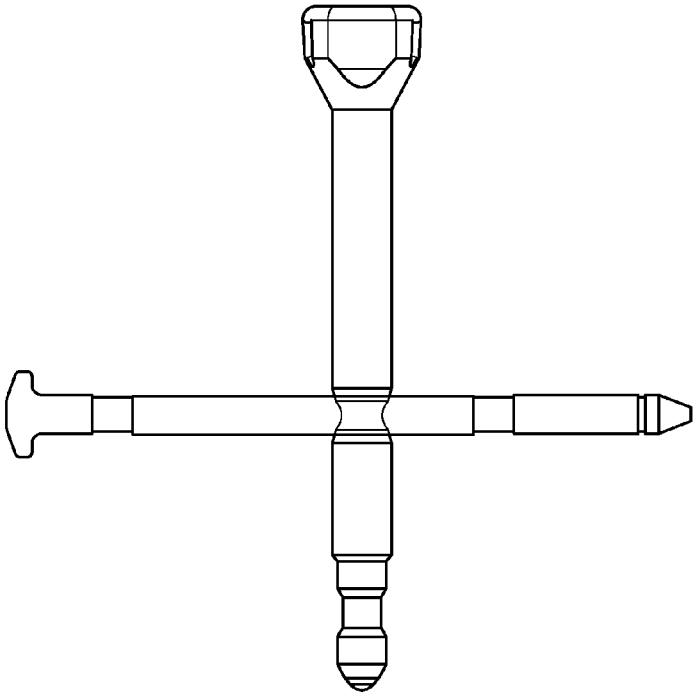
FIG. 2D is a view of the two shafts together as they seat in the cross locking mechanism.

Referring to FIGS. 2A-2C, one implementation of a cross block 3 is shown. FIG. 2A is a side view of the cross block 3. The horizontal shaft 2 rests in a recess 532. FIG. 2B shows a plan view of the cross block 3. The vertical shaft 1 fits into aperture 36. FIG. 2C shows a perspective view of the cross block 3. The cross block shown in FIG. 2 is similar to the cross block in FIG. 2C, however the recess 532 in FIG. 2C is covered to form aperture 32 in FIG. 2. As can be seen from FIG. 2C, the recess 532 intersects aperture 36 at region 510. Region 510 is where the horizontal shaft 2 rests in a notch 19 on the vertical shaft 1, as described further with respect to FIG. 3.

When inserted through the cross block 3, the horizontal shaft 2 extends through the cross block 3 approximately perpendicular to the vertical shaft 1. The terms vertical and horizontal are used to indicate the relative orientation of the shafts in the figures and are not meant to be limiting. The horizontal shaft 2 can be formed of any material that is both sturdy, e.g., cannot be broken by a human using bare hands, but easily broken by a human using a tool, such as a bolt cutter. In some implementations, the horizontal shaft 2 is a bolt. The shaft can be formed of a ceramic, a metal, or other suitable material. Referring back to FIG. 2, the horizontal shaft 2 has a body 20. In some implementations, at the end of the body 20 is a head 21. The head 21 has a width, diameter or circumference that is greater than a corresponding width, diameter or circumference of the body 20. In some implementations, the horizontal shaft 2 has one or more notched sections 23, 25. The notched sections 23, 25 facilitate the cutting or breaking of the horizontal shaft 2. The notched sections 23, 25 can extend around the entire circumference of the shaft 2. Although a single notched section may be sufficient, two or more notched sections provide multiple locations for breaking the vertical shaft 2, for example, if one of the notched sections is not easily accessible to a cutting tool or if the first attempt to cut the shaft at a first notch is unsuccessful. A notch is not so far from its respective end of the shaft that the shaft can be positioned such that the notch can intersect with a notch in the vertical shaft (described below) when the horizontal shaft 2 is locked into place. The horizontal shaft also has an end 27 configured to fit into a locking device (see locking barrel 4 in FIG. 1). The end 27 can have circumferential grooves, ridges, bumps or other features that fit into the locking device and prevent the horizontal shaft 2 from being removed from the locking device. In some implementations, the end 27 is pointed to a sharp or rounded point.

Figure 3:
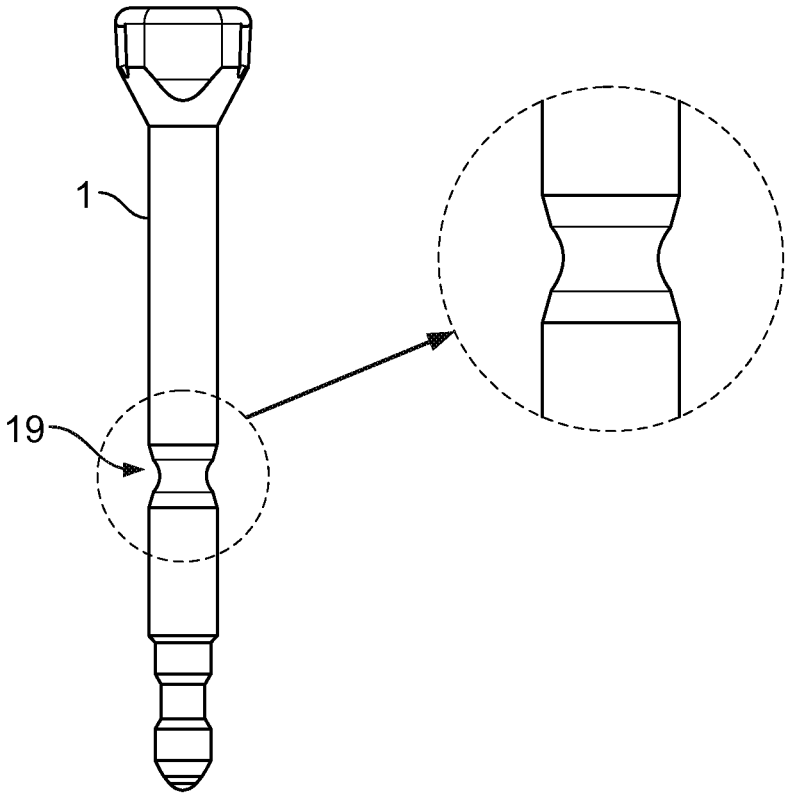
FIG. 3 is an enlarged view of one of vertical shaft.

The horizontal shaft 2 when in the cross block 3 keeps the vertical shaft 1 from being removed from the cross block 3. Referring to FIG. 3, the vertical shaft 1 has a notch 19 in which the horizontal shaft 2 rests. The notch 19 is formed with a shear mitigation angle, such as an angle of between about 15 and 60, or between 12 and 18 degrees, for example, an angle of about 15 degrees from the plane of the body of the shaft 2. The shear mitigation angle prevents the vertical shaft 1 from shearing the horizontal shaft 2 when the device is subjected to impact force such as hammering the device when it is secured onto a container hasp or during testing, such as ISO 17712 compliant impact and tensile tests. The depth and shape of the notch, which is a circular notch, keeps both of the shafts in place within the cross block 3. When force is applied to pull out the vertical shaft 1, the horizontal shaft 2 is squeezed between the cross block 3 and notch 19. As the vertical shaft is pulled out from the cross block 3, the engagement between the shafts 1, 2 and the cross block 3 increases. Without the shear mitigation angle, the horizontal shaft is simply "cut" by the edges of the notch on the vertical shaft and the vertical shaft can be disengaged and pulled out. In some embodiments, the notch has two areas. An inner region of the notch has a circular cross-section along the longitudinal axis of the shaft. Two outer frustoconical surfaces are tapered inwardly along the longitudinal axis to give the shaft reduced diameter toward the inner region. The shear mitigation angle can provide sufficient shear mitigation to the shaft that the shaft complies with the ISO 17712 standard. The notch 19 is sufficiently deep and the horizontal shaft 2 is sized, e.g., is sufficiently small, that a enough of the horizontal shaft 2 can rest in the notch 19 and prevent the vertical shaft 1 from being pulled out of the cross block 3 once the horizontal shaft 2 is in place. The vertical shaft 1 can have a diameter along most of its body that is between about 8 and 12 mm, such as between 8.5 and 11 mm, for example, about 10.5 mm.

Figure 4:
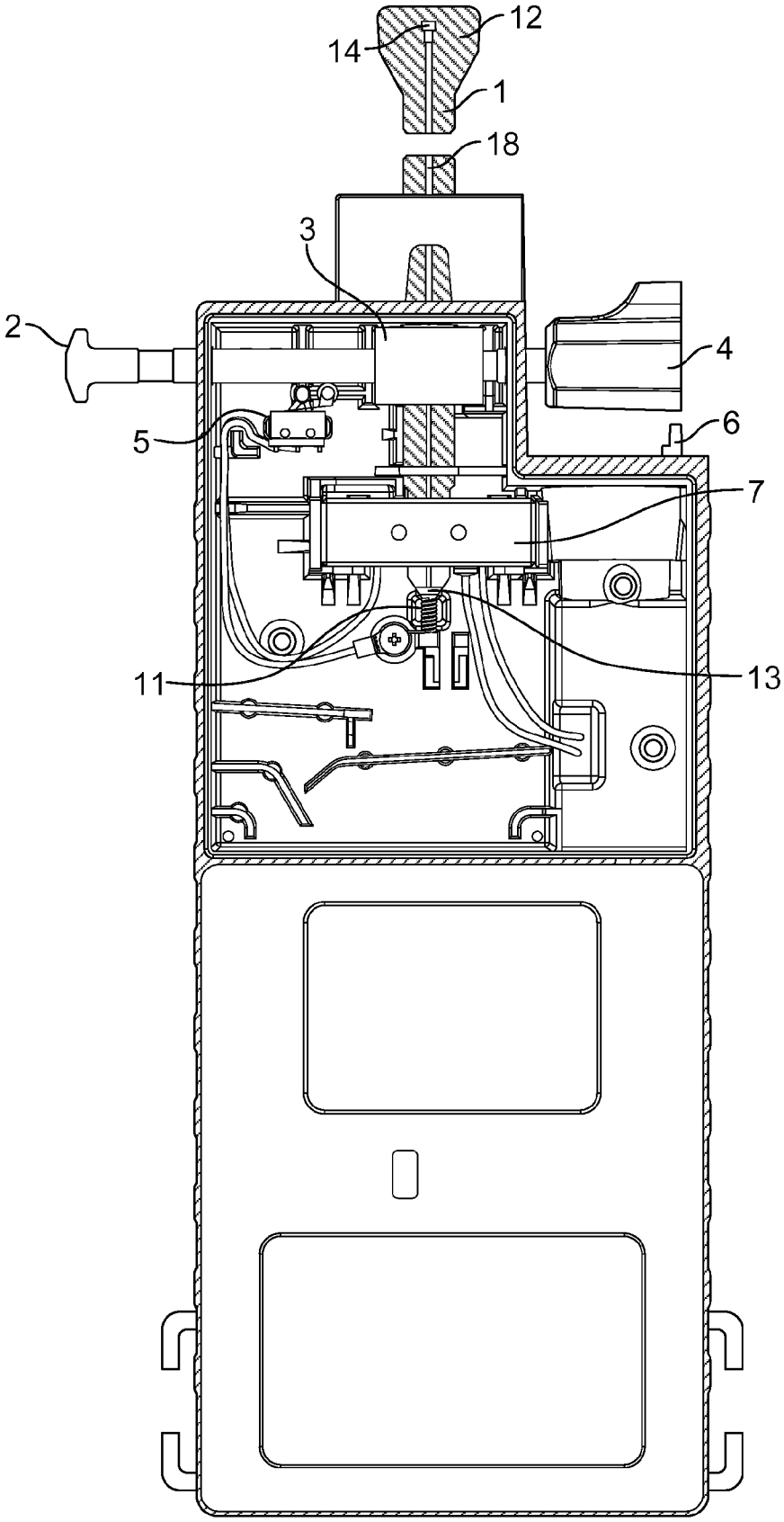
FIG. 4 is another plan view of the device with the locking compartment exposed.

Referring to FIG. 4, the vertical shaft 1 has a head 12. The head 12 is the portion of the vertical shaft 1 that extends outside of the locking compartment 110. The head 12 has a greater width, circumference and/or diameter than the main body of the shaft 1, which prevents the device 100 from falling out of position when locked onto a container. An insulated wire 18 extends through the vertical shaft 1. The insulated wire 18 is connected in the head to the exterior of the shaft, such as through a conductive bridge 14. The conductive bridge 14 is formed of a conductive material, such as a metal, for example copper or brass. The insulation prevents the conductive wire from being in electrical contact with an external surface of the shaft 2 along the length of the wire. The exterior of the shaft, the conductive bridge and the insulated wire form a conductive path. At an end of the vertical shaft 1 opposite form the head is an insulated portion 13 that extends around the circumference of the vertical shaft 1. The insulated portion 13 is formed of an insulating material, such as a insulated fiber board or rubber. The insulated portion 13 extends all the way through to the insulation of the conductive wire or to the wire. Thus, while the shaft 1 is intact, the wire 18 is in conductive contact with a conductive end 22 of the shaft 1 that is on the other side of the insulated portion 13 from the head 12 and abuts the insulated portion 13 (see FIG. 2). In some implementations, the vertical shaft 1 houses an open loop wire that forms a partial circuit, rather than the single insulated wire 18, conductive bridge and exterior of the shaft forming a partial circuit. The vertical shaft 1 can be solid and free of any gaps or hollow interior spaces.

Referring to FIG. 2, between the insulated portion 13 and the head is a notched segment 15. When the vertical shaft 1 is in place, the notched segment 15 sits within an indicative locking mechanism body 7. At least two locking mechanism inserts 8 are held against the vertical shaft 1, such as within the notched segment 15, by an indicative locking mechanism spring 9 and an indicative locking mechanism stopper 10. The spring 9 is between the insert 8 and the stopper 10 and holds the insert 8 tightly against the vertical shaft 1. The locking mechanism body 7, springs 9, inserts 8 and stoppers 10 hold the vertical shaft 1 in position, i.e., in electrical contact with the circuit, so that the housing 225 must be pulled off of the vertical shaft 1 with some measure of force. The spring tension is sufficient to hold the vertical shaft 1 in place, but not so high that a user has difficulty in removing the shaft 1 from the housing 225. The inserts 8 are electrically conductive and can provide a connection to ground through an exterior of the vertical shaft 1, exterior of the device and the container on which the device is located. The inserts 8 are in horizontal opposed alignment. Should vibration occur, which could momentary disconnect the vertical shaft, once the inserts are in place, the opposing inserts provide added compression and enhance electrical contact. This maintains the closed electrical loop and prevents any false tamper signals, as described below. In some implementations, the locking mechanism body 7 has an aperture 37 for connecting to the circuit. In some implementations, the locking inserts have apertures for connecting to the circuit.

Referring to FIG. 4, which shows a cross section of the vertical shaft 1, the tip of the vertical shaft 1, that is the end that is opposite from the head 12, exposes the conductive wire that extends through the center of the shaft. Alternatively, the tip is a conductive piece electrically connected to the conductive wire. In some implementations, the end of vertical shaft 1 is constructed similar to a TS connector. When in the device, the tip of the vertical shaft 1 is in electrical contact with a spring 11. The spring 11 provides shock absorption. During shipping (note that this term applies to any type of cargo movement and not is restricted to over water transport), a container and therefore the device experiences a number of environmental disturbances, such as being bounced around. The device is thus likely to bounce or get slammed against the container. The spring 11 maintains the contact between the wire in the shaft 1 and the rest of the circuit.

The horizontal shaft 2 is locked into place by locking barrel 4. The locking barrel 4 is constructed so that it can be placed onto the end of the horizontal shaft 2 and stays in place even when a modest amount of pressure is applied to pull the locking barrel 4 away from the shaft 2. However, if the locking barrel 4 is pulled away from the shaft 2 sufficiently hard, the components within the barrel 4 that grip the shaft break. Once broken, the locking barrel cannot hold itself on the shaft without, e.g., an adhesive. In some implementations, the internal components that grip the shaft 2 are brittle or frangible. In some implementations, a jaw lock type device inside the locking barrel 4 prevents the barrel from being pulled off the shaft once attached.

Figure 5:
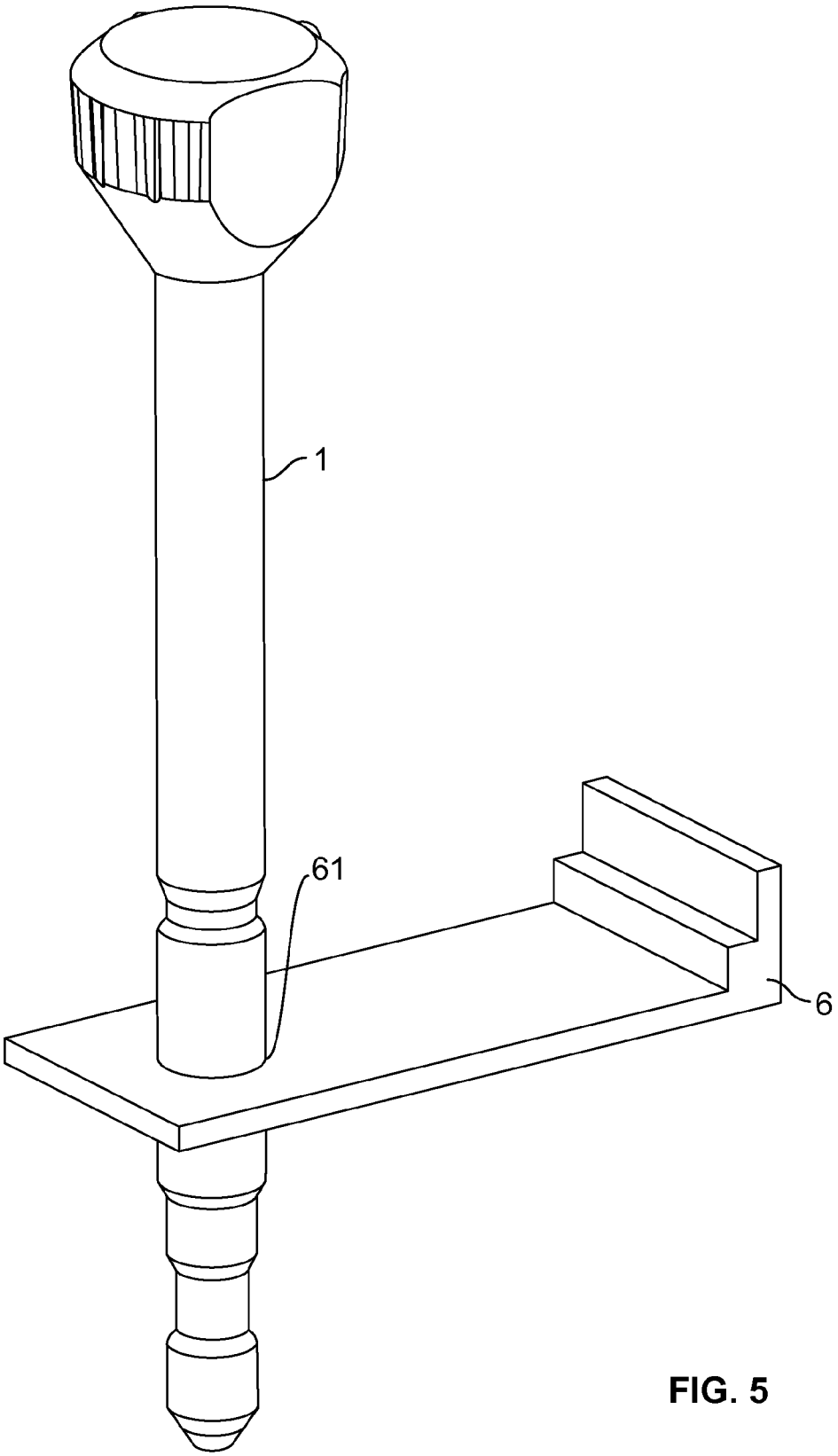
FIG. 5 is an exploded view of part of the vertical shaft engaged with an interlocking cover.

Referring to FIGS. 1 and 5, when the vertical shaft 1 is in the device, the shaft 1 extends through an aperture 61 in an interlocking cover 6. The device is formed so that the interlocking cover 6, when not locked in place by the vertical shaft 1, is moveable, such as slidably moveable, between an open and a closed configuration. The aperture in the interlocking cover 6 is only large enough for the vertical shaft 1 to fit therethrough, i.e., the vertical shaft can fit through the aperture 61 to prevent horizontal movement of the cover 6. The aperture is sufficiently small to prevent opening a chamber 114 that is covered by the cover 6 when the vertical shaft 1 is in place. The vertical shaft 1 can only be inserted when the cover 6 is either not in the device or when the cover 6 is in a closed position. In some implementations, the locking barrel 4 is positioned over the cover 6 and is sufficiently large enough to prevent access to the chamber 114 by breaching the cover 6, such as by drilling through the cover.

The cover 6 can seal with the housing 225 of the device so that water cannot enter the chamber 114 covered by the cover 6. The cover 6 when closed covers the chamber 114 holding a connector 150, which enables a user to physically connect to the device to download, upload or reset information. The connector 150 can provide power access to the device as well as input and output access. The connector 150 can be a waterproof connector, such as a 6 pin waterproof connector. A dust cover 140 can be on the end of the connector 150. A battery within the device can also be charged through the connector 150. The battery can be located, for example, in the electronics compartment 210. The connector 150 can be connected to ground, e.g., through the indicative locking mechanism body 7.

Figure 6:
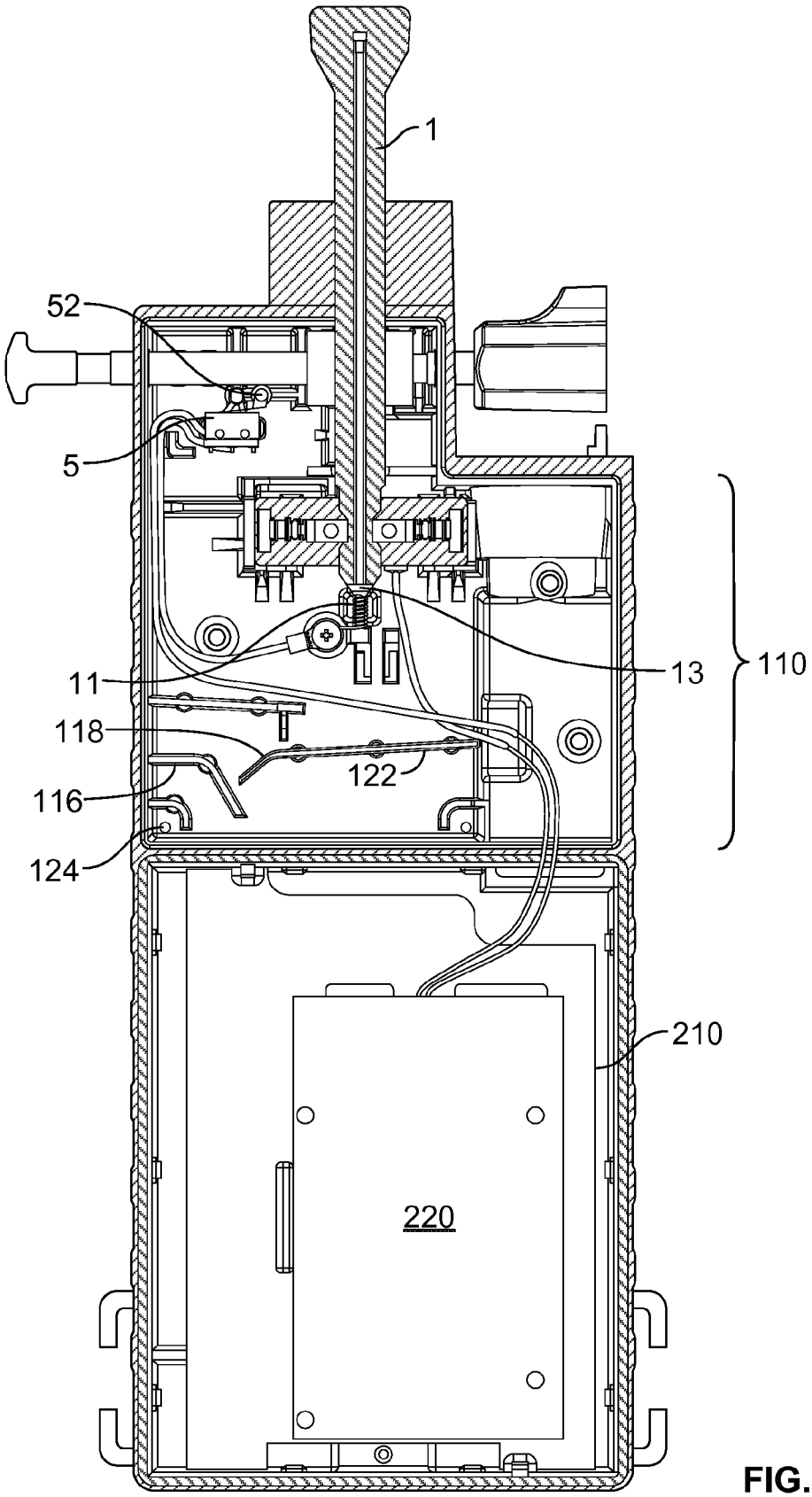
FIG. 6 is a plan view of the device with the locking compartment and electronic compartment exposed.
Figure 13:
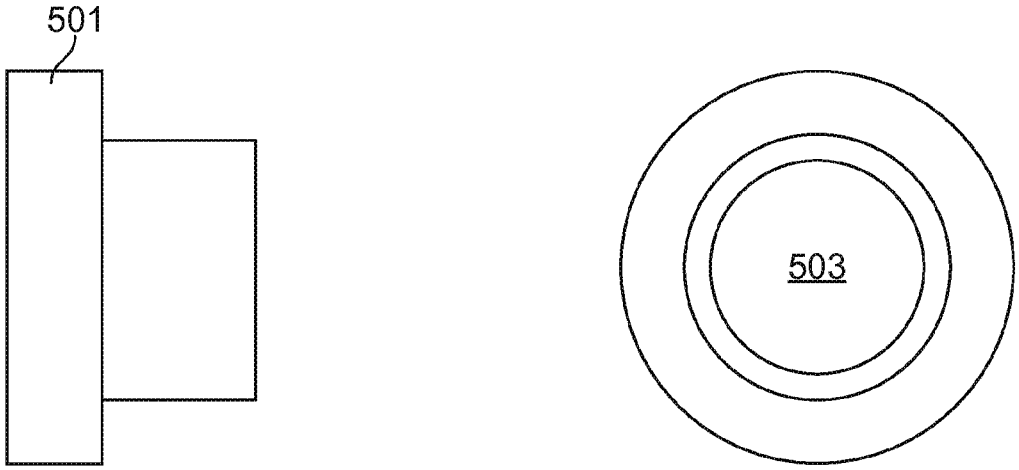
FIG. 13 shows a grommet.
Figure 14:
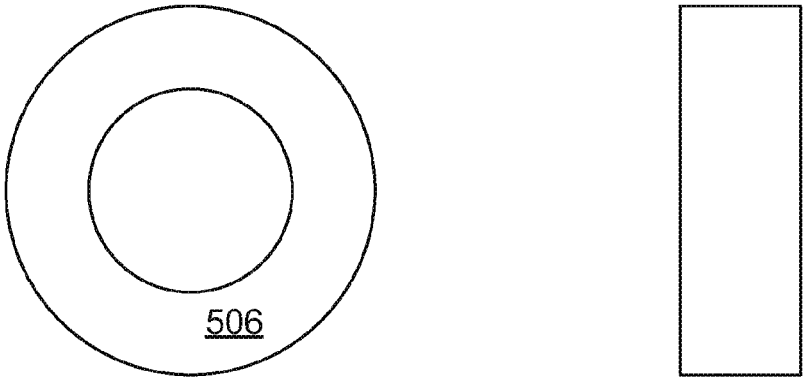
FIG. 14 shows a washer.
Figure 15:
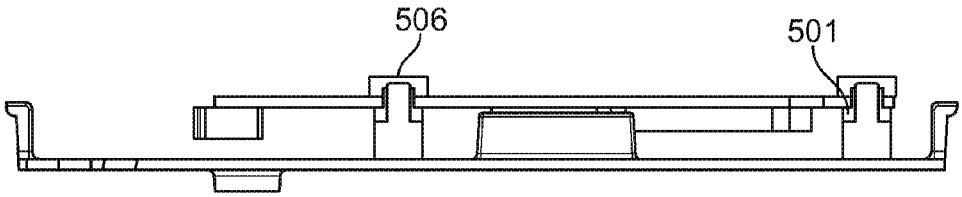

Referring to FIG. 6, the electronics compartment 210 can also house a circuit board 220, such as a PCB. The PCB can support a number of chips, including memory, a transmitter, a processor and a GPS device. The PCB can be electrically connected to the connector 150, ground, e.g., through indicative locking mechanism body 7, and a switch 5, described further below. The connection to the indicative locking mechanism body 7 can be by a wire harness receptacle attached to the body with a contact screw. Because the PCB tends to be sensitive to vibration or jolts, a shock absorptive material can be placed between the circuit board 220 and the housing 225. In some implementations, the PCB is mounted in a chamber on mounting posts. Both vertical and horizontal shock absorption is provided around the mounting posts. The absorptive material can be formed of a compliant material such as a rubber. For example, as shown in FIGS. 12-15, a rubber grommet 501 can cover a mounting post 502 and extend upwards through a mounting hole in the PCB. As shown in FIG. 13, the grommet 501 is a radially symmetric component with a T-shaped cross-section and an aperture 503 though it's axis of symmetry. As shown in FIG. 14, a washer 506 is an o-shaped ring. The washer 506 can sit on top of the PCB to cushion it from the top cover of the housing. Thus, the PCB is insulated from any direct vibration of the housing by a compliant material, such as rubber or PORON, which provides a high compression ratio. In some implementations, the washer can fit over the smaller section of the grommet and over a portion of the PCB. A side of the washer opposite to the PCB can provide shock absorbing between the device cover and the PCB. Thus, a small section of the washer provides horizontal shock absorbing to the PCB. The larger portion of the grommet provides vertical shock absorbing to the bottom side of the PCB. If the washer is formed of a high compression ratio material, the washer provides shock absorbing to the top surface of the PCB as well as absorbs any compression force on the cover, mitigating the transfer of force to the PCB. A total of four such mounting posts can be used. In some implementations, the shock absorbing material seals the electronics compartment 210 off form the locking compartment 110. In some implementations, wires extending from the locking compartment 110 into the electronics compartment 210 are electrically connected to the circuit board 220 and extend through the shock absorbing material. This prevents any moisture that might enter the locking compartment 110 from entering the electronics compartment 210 and affecting the electronics. Alternatively, a separate washer or adhesive, such as of a waterproof silicon material, seals the space between the wires and the aperture in the electronics compartment 210 that the wires lead through.

Because the device 100 is likely to be exposed to the elements, e.g., rain, snow, and high humidity from being at sea, and because the locking compartment 110 is not sealed off from the environment, water is likely to collect inside a chamber 114 of the locking compartment 110 at some point. Water can enter the chamber down the sides of vertical shaft 1. Baffles 116 within the chamber 114 can direct water toward a bottom of the chamber 114. The water can then exit out drainage apertures 124 leading to the outside of the device 100. The device 100 is generally in the upright position shown in FIG. 1 when in use. The baffles 116 each have at least a downward sloping section 118 in addition to a generally horizontal portion 122. The generally horizontal portion 122 can be partially downward sloping, as well. In some implementations, baffles 116 partially surround the one or more drainage apertures 124. The baffles 116 surrounding the drainage apertures 124 can prevent water from entering the device through the apertures. The baffles 116 can also prevent the device being tampered with through the drainage apertures 124. For example, one or more of the baffles 116 can extend most of the way around the drainage apertures 124, such as at least 80% of the way, such as at least 90% of the way or so that water can move between the gap between the baffle and the housing, but an intruding device, such as a wire, cannot. In some implementations, the baffles extend from an interior of a front wall 130 of the device (front wall shown in FIG. 7) to a back wall 132 of the device.

In addition to device having internal baffles 116, some components within the locking chamber 110 are closed off from chamber 114 to prevent water from damaging the components. A switch 5, such as a micro switch, is part of the electrical circuit. The switch in some implementations is environmentally sealed. Insertion of the horizontal shaft 2 into the device 10 activates an actuator 52 of the switch 5, closing the circuit. The activation of the actuator 52 is caused by the friction of the shaft 2 along the switch 5. Removal of the horizontal shaft 2 deactivates the actuator 52, opening the circuit. The switch 5 can be connected to both the circuit board 220, the locking body mechanism 7, e.g., for ground, and to the internal wire of the vertical shaft 1, e.g., through spring 11.

Figure 7:
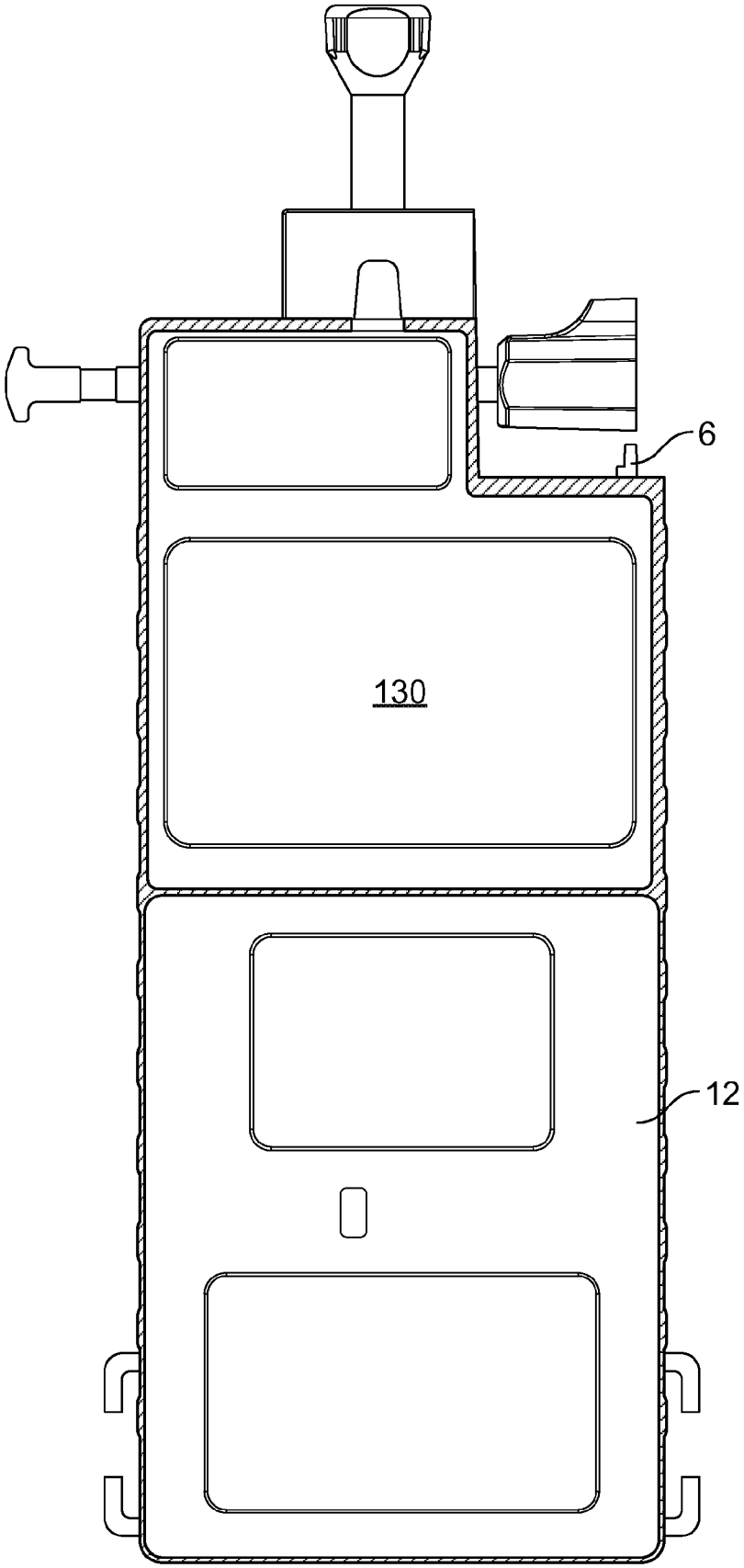
FIG. 7 is a plan view of the device in a closed and locked configuration.

Referring to FIG. 7, the housing 225 that forms the electronics compartment 210 and locking compartment 110 cannot be opened, other than through the apertures where the shafts are inserted, the cover 6 or by destroying the integrity of the housing 225. The housing is formed from more than one piece, the pieces being bonded together, such as by welding or with an epoxy, e.g., a water resistant epoxy. The housing is free of mechanical fasteners, such as screws, which might otherwise hold the pieces of the housing together to form the unit. The housing 225 can be formed of a rigid material, such as a metal.

In addition to protecting from breach by bypassing the electrical breach detection system, the housing 225 can protect the internal electronics (in an electronics compartment 210) from solids, such as dust. In some implementations, the housing 225 totally protects the internal electronics, e.g., the electronics with in the electronics chamber 210 from dust. The housing 225 can also protect the electronics from water, such as from low pressure jets of water or even against the effect of immersion of the device in water that is between 15 cm and 1 meter deep. In some implementations, the housing 225 includes an IP67 electronics chamber. The housing can have internal posts that maintain the structural integrity of the device. The posts, any welding and the housing in general can be MIL 810F compliant. That is, the device can be impervious to environment shock, e.g., various weather conditions, fungus, salt, fog, sand, dust, acceleration, vibration and other potentially damaging circumstances. The exterior of the device can also include indicator lights, such as green, yellow or red LEDs that indicate a status of the device, such as a battery status, an in-use status or an open circuit status.

Figure 8:
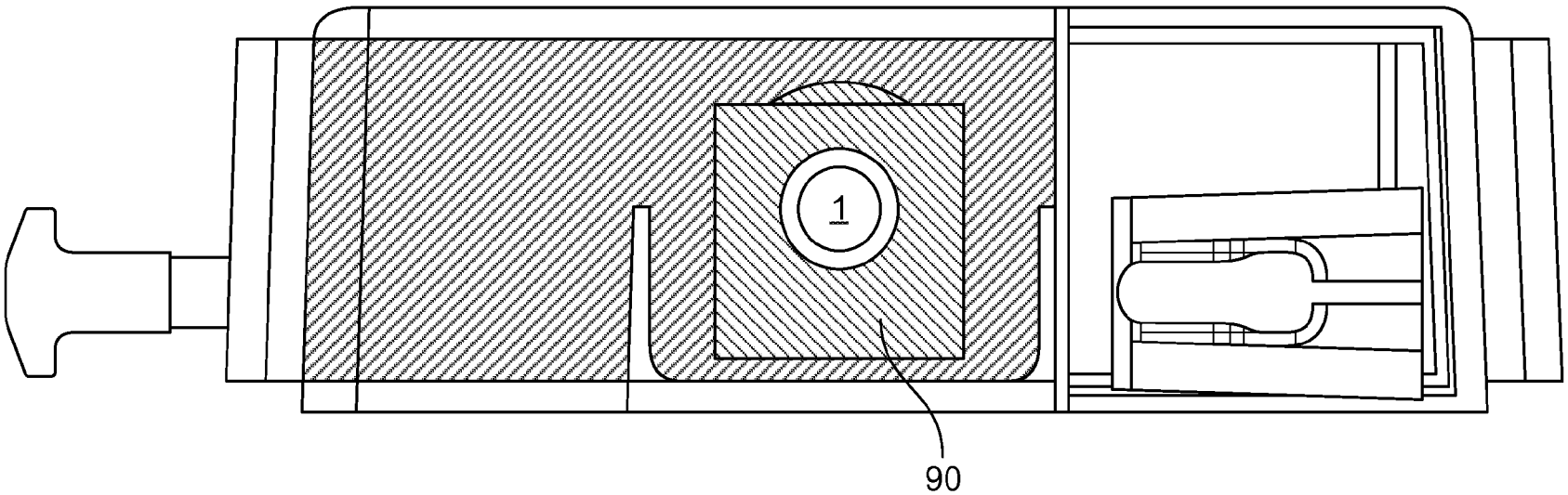
FIG. 8 is a top view of the device.

Referring to FIGS. 1 and 8, a top view of the device shows a cover 90, which fits around an extending piece on a container. Cover 90 protects the vertical shaft, covering the exposed potion of the vertical shaft when the vertical shaft is secured onto a container. The cover 90 can prevent a user from cutting the vertical shaft.

Figure 9:
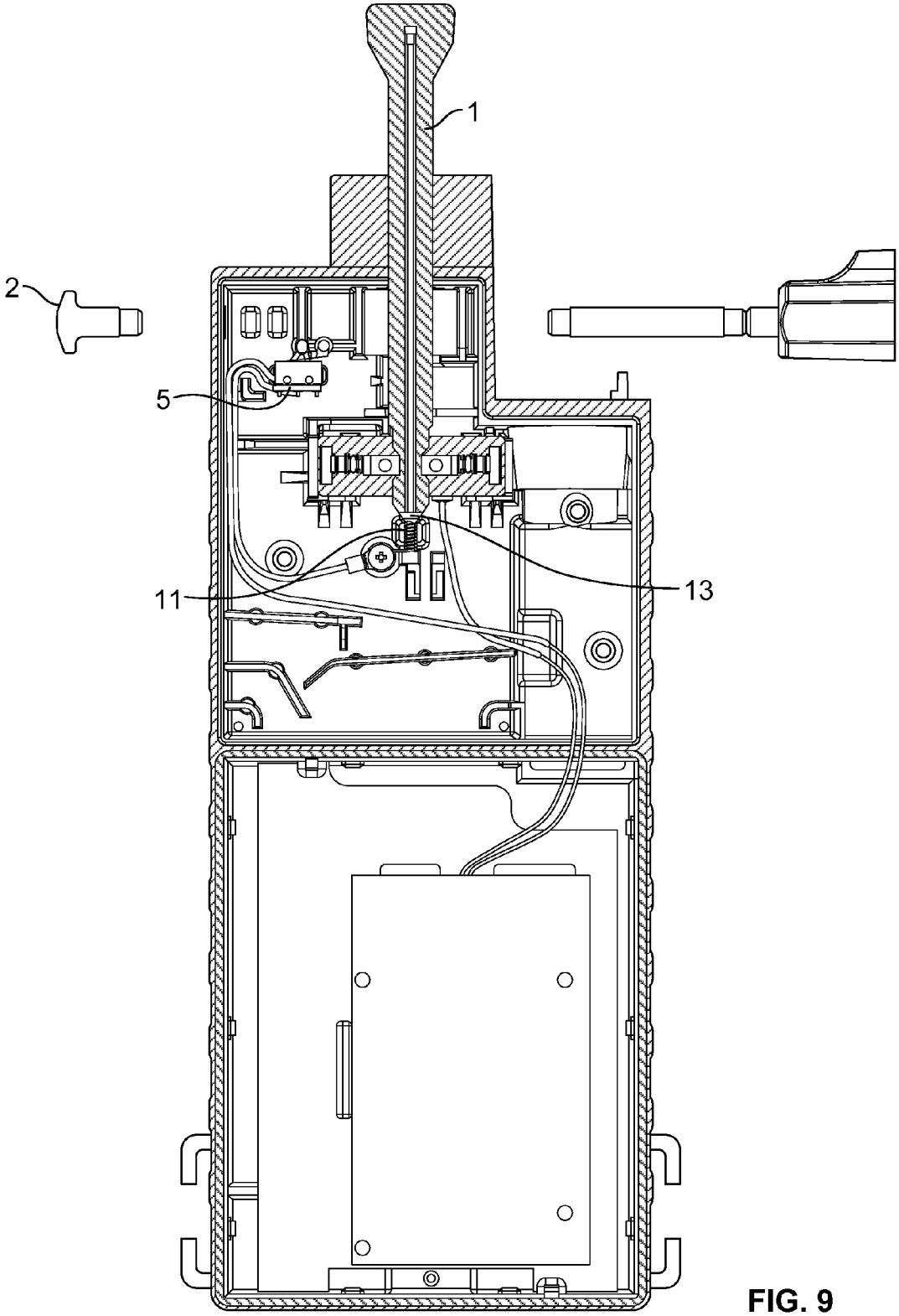
FIG. 9 is a plan view of the device having the internal portions exposed and the locking shaft cut and removed.

Referring to FIG. 9, when the horizontal shaft 2 is broken, such as at one of the notches 23, the horizontal shaft 2 can be removed, opening the circuit at switch 5. This allows for removal of the horizontal shaft 2 from the housing 225.

Figure 16:
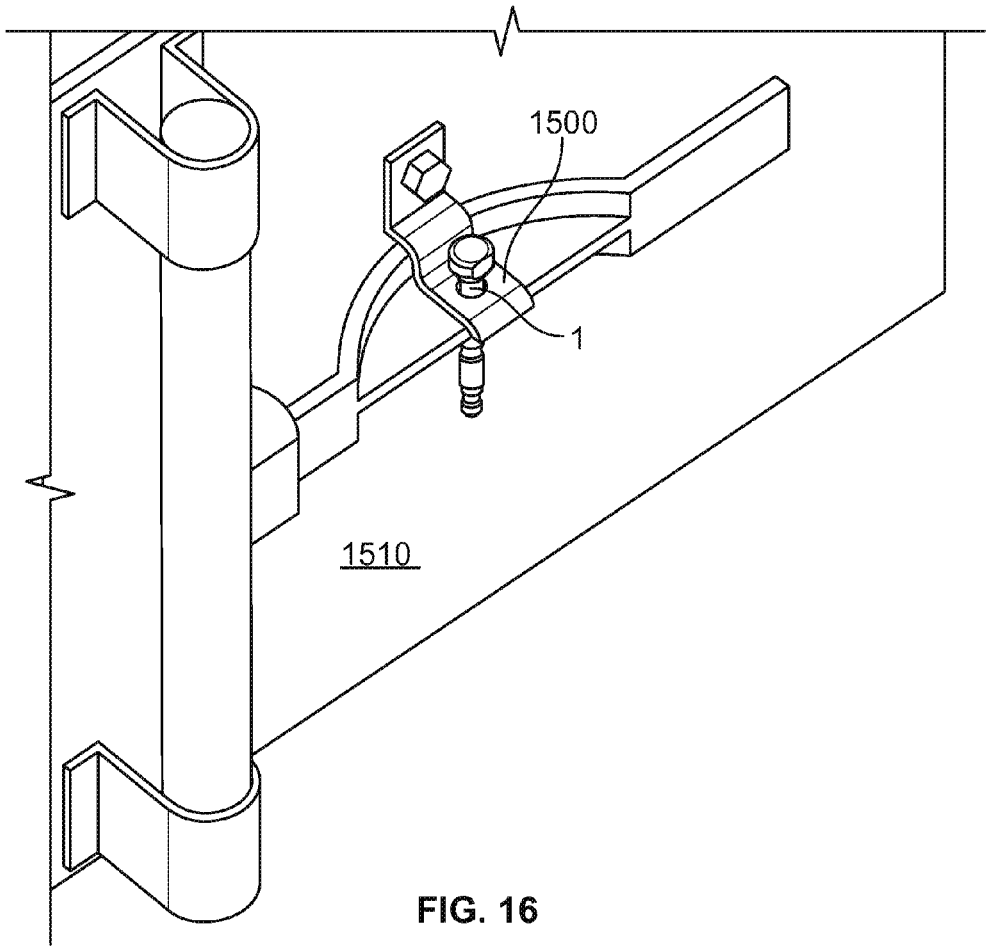
FIG. 16 is a perspective view of the horizontal shaft within a hasp on a container.

Referring to FIG. 16, the vertical shaft 1 is shown inserted into an aperture of a hasp 1500 of a container door 1510. The aperture of the hasp 1500 is sufficiently large to accommodate the shaft of the vertical shaft 1. One potential problem with the hasp 1500 on the container door is that the apertures in the two parts of the hasp do not always align well with one another. Lack of alignment can make it difficult to place a vertical shaft that is unbendable or entirely rigid through the two apertures. The hasp apertures can also be misshapen from use over time. The hasp apertures can be too small for the vertical shaft to fit into or too thick for the shaft to seat properly in. Another potential problem is when the apertures in the hasp cause the vertical shaft to sit at an angle that makes attaching the rest of the device, e.g., the locking compartment, difficult or impossible. When the shaft angles toward the container, the locking compartment may not fit between the shaft and the container. In some instances, some component of the container or hasp protrudes in such as way that makes putting the shaft through the hasp apertures difficult to impossible.

Figure 17:
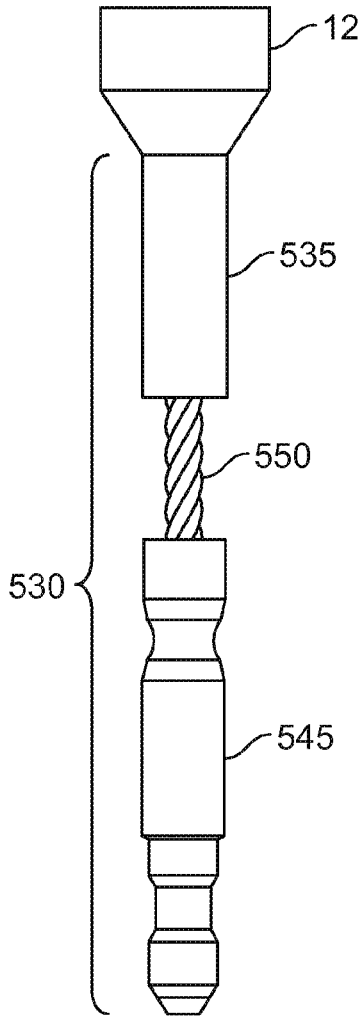
FIGS. 17-18 are side views of hybrid vertical shafts.

In some implementations, a hybrid version of the vertical shaft includes both rigid and flexible portions. Referring to FIG. 17, in some implementations of the flexible shaft, the shaft body 530 is connected to head 12. The shaft body 530 includes an upper rigid portion 535 that is directly contacting head 12, a lower rigid portion 545, which includes the notch 19, and a flexible portion 550 between the upper rigid portion 535 and the lower rigid portion 545. In some implementations, the diameter of the upper and lower rigid portions is between about 8 and 12 mm, such as between 8.5 and 11 mm, for example, about 10.5 mm. The upper rigid portion can be between 25 and 50 mm long, such as 25, 30, 35, or 43 mm long. The lower rigid portion is at least 70 mm long, such as about 75, 80 or 85 mm long. The flexible portion 550 can be between 10 and 35 mm long, such as 15, 20, 25, or 30 mm long. The overall length of the shaft can be less than about 175 mm long.

Figure 18:
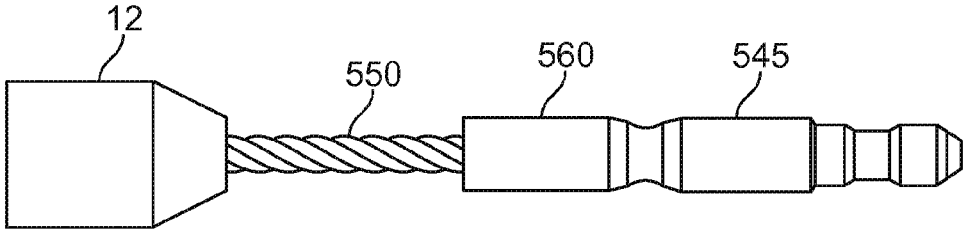

Referring to FIG. 18, in yet another implementation, the vertical shaft 1 has the flexible portion 550 directly adjacent to the head 12. The flexible portion 550 connects to a rigid, but compliant portion 560, which connects to the lower rigid portion 545. In some implementations the head 12 of the shaft 1 is formed of an insulating material. In some implementations, the rigid but compliant portion is an insulating material.

Combinations of the implementations shown in FIGS. 17 and 18 are also possible. In some implementations, the flexible portion is formed of a wire rope, such as a steel rope.

Similar to the entirely rigid vertical shaft, the vertical shafts having a flexible portion include an electrically conductive circuit. The circuit extends from the end of the shaft, through the lower rigid portion, through the flexible portion and into the head. The flexible portion is fabricated with an insulated core. One or more conductive wires run through a center of the insulated core. For example, one or two wires can form a loop within the head of the shaft. One of the wires or one end of a single wire is then conductively connected to the insulated wire in the lower rigid portion, which is then electrically connected to the end or tip of the shaft 1. The other wire is conductively connected to the outer portion of the lower rigid portion. In instances where there is a rigid, but compliant material between the flexible portion and the rigid lower portion, and the rigid, but compliant material is formed of an insulating material, such as rubber or plastic, the two wires or wire portions in the flexible portion continue through the rigid, but compliant material.

Figure 19:
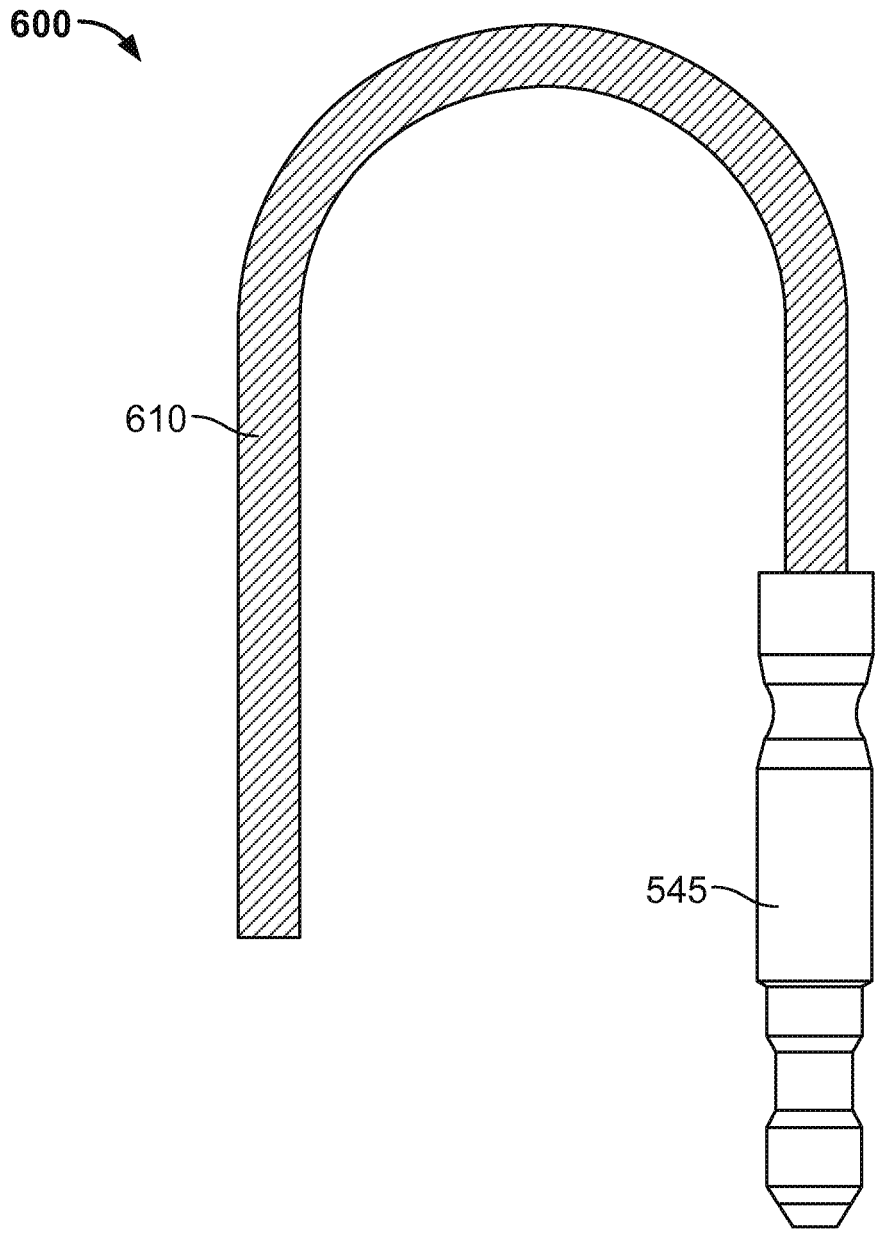
FIG. 19 is a side view of a cable device.

Referring to FIG. 19, in some implementations, instead of an entirely rigid vertical shaft 1, a flexible cable 600 is used. The cable includes the lower rigid portion 545 (also just referred to as a shaft), similar to the hybrid implementations of the vertical shaft described above. A flexible portion 610 is attached either directly to the lower rigid portion 545 or to a rigid, but compliant material, which is connected to the lower rigid portion 545. The flexible portion 610 has an insulated conductive core, such as with one or two conductive wires through the center of the flexible portion 610. In instances with two conductive wires, a loop or conductive connector connects the two wires at an end of the flexible portion 610 that is opposite to the lower rigid portion 545.

The cable 600 can be made as short or as long as desired. A long cable can be used where the cable is wrapped around a container. A shorter cable can be used to secure locking bars on a container or in any other situation where a shaft style shaft may not fit or be suitable to secure two parts of a container together.

Figure 20:
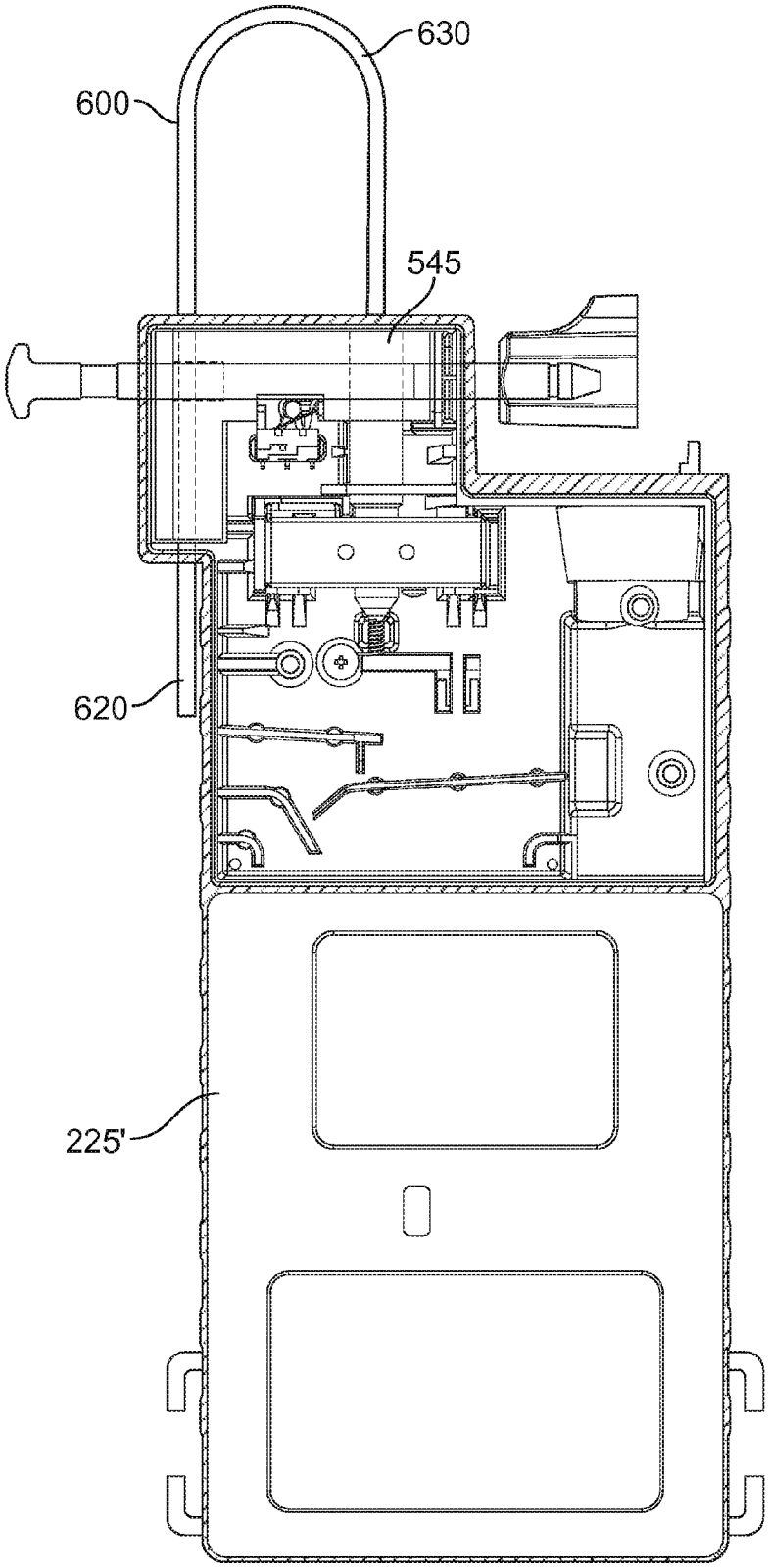
FIG. 20 is a plan view of the device in a closed and locked configuration using the cable.
Figure 21:
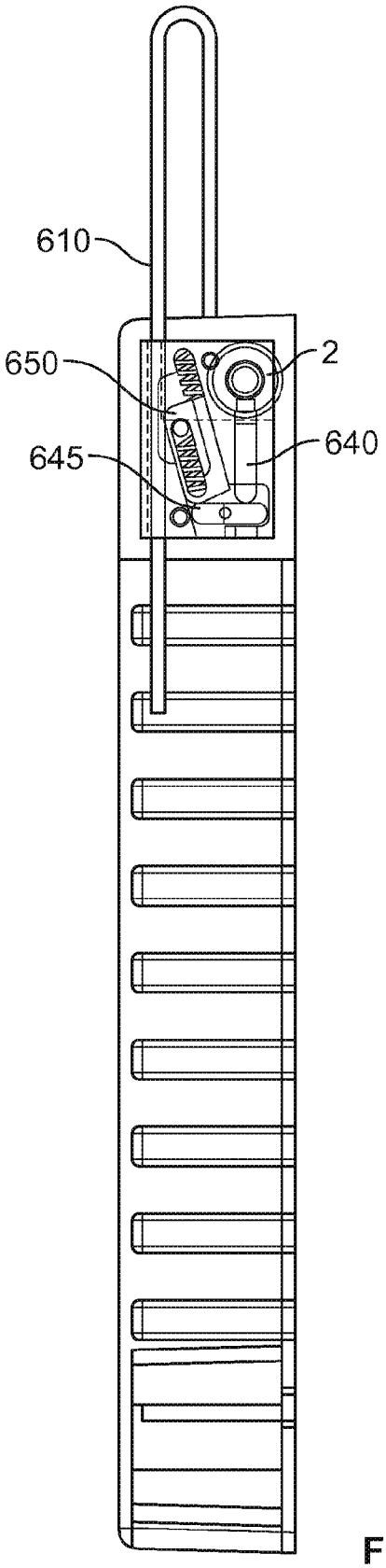
FIG. 21 is a side view of the device in a closed and locked configuration using the cable.

Referring to FIG. 20, the cable 600 can be used with a version of the housing 225'. The housing 225' is similar to the housing 225 described with respect to the rigid or hybrid vertical shaft 1, but has an additional aperture for containing the end of the cable 600. The lower rigid portion 545 of the cable fits into the housing 225' in a similar manner as the rigid or hybrid vertical shaft. A part of the flexible portion 610 extends out of the housing 225' and back into the device body 101' when locked into the device housing 225'. In some implementations, an end 620 of the cable opposite to the lower rigid portion 545 extends out of the housing 225'. The extending end indicates that the cable is inserted sufficiently far into the device that it is locked into place. Also, because the end extending out of the device can pulled just a little ways out of the device or further out of the device, the length of cable that forms loop 630 is adjustable.

Inside of the locking compartment 110, an inverse incline mechanism secures the cable in place once the horizontal shaft 2 is inserted into the device body 101'. The inverse incline mechanism includes multiple components that work together, including a vertical bar 640, a horizontal bar 645 and a spring activated incliner 650. When in the device body 101', the horizontal shaft 2 presses on the vertical bar 640. The vertical bar 640 in turn presses on horizontal bar 645. When the horizontal bar 645 is in a pressed position, the spring activated incliner 650 tilts into a position that holds tight against the flexible portion 610 of the cable. When the horizontal shaft 2 is removed from the housing 225', the spring activated incliner 650 is released and tilts into a position that allows the cable to be released from the device body 101'. In some implementations, the flexible portion 610 within the housing 225' is at the same electrical potential as housing 225', even when an electrical potential is applied to the rigid portion of the cable or the wire within the cable. In other implementations, the inverse incline mechanism is connected to the electrical circuitry so that when the flexible portion 610 of the cable is removed from the housing 225', such as by force, the inverse incline mechanism indicates a breach in the device. The breach is subsequently logged into the system.

Figure 22:
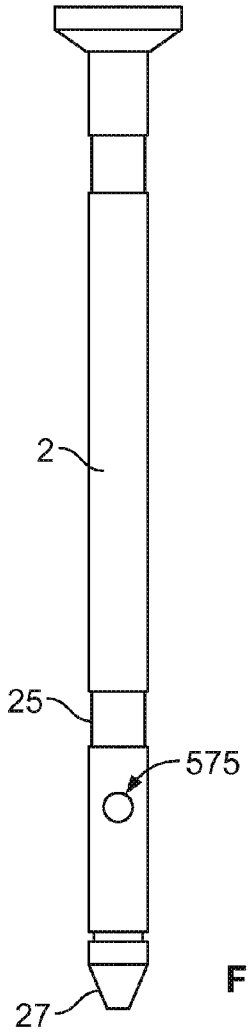
FIG. 22 is a side view of a horizontal shaft.

Referring to FIG. 22, in some implementations, the horizontal shaft 2 has an aperture 575 for accepting an indicative security device. The aperture 575 extends through the horizontal shaft 2, such as perpendicular to a main axis of the shaft. The aperture 575 is placed between a notch 25, e.g. the notch that is closest to the end 27 of the shaft 2 if the shaft includes multiple notches, and the end 27 of the shaft 2. The aperture 575 can be sized to accept a standard commercial indicative seal, such as a plastic seal. The indicative seal can take the place of the locking barrel 4, shown in FIG. 1.

Figure 23:
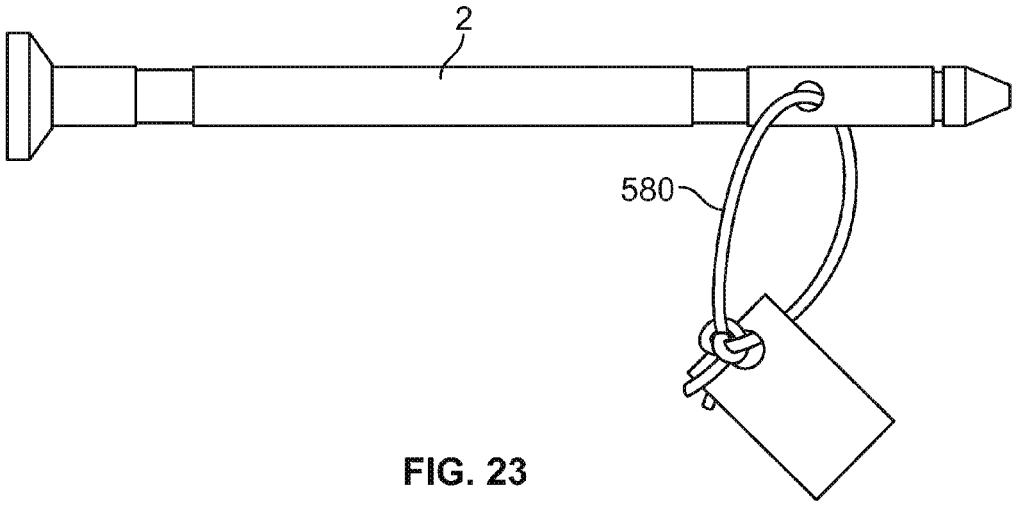
FIG. 23 is a side view of a horizontal shaft with an indicative seal.

Referring to FIG. 23, an indicative seal 580 when placed through the aperture 575 and closed locks the horizontal shaft in place. That is, assuming the shaft is inserted through the cross block 3 (as shown in FIG. 1), the indicative seal 580 prevents the horizontal shaft 2 from being pulled out of the cross block 3, because the plastic seal 580 cannot fit through the aperture in the locking compartment 110. Thus, the horizontal shaft 2 with the indicative seal 580 locks the vertical shaft in place. When the vertical shaft 1 is on a container, such as through apertures in a hasp, the horizontal shaft 2 with the indicative seal 580 locks the hasp on the container. This indicative seal 580 can be removed easier and faster by the authorized party to the transaction, than cutting the metal barrier horizontal shaft. However, the indicative seal 580 may not be in compliance with some industry standards and therefore may not be used in all instances. The horizontal shaft 2 cannot be removed without either breaking or breaching the indicative seal or breaking the horizontal shaft.

The indicative seal 580 can provide an even lower consumable part cost than the horizontal shaft 2. In some implementations, the indicative seal includes an identification or serial number. If tampered or removed by an unauthorized party, the lack of a seal or a seal without the correct identification or serial number can provide a visual indication of tampering, in addition to any electronically received indication of tampering.

Figure 24:
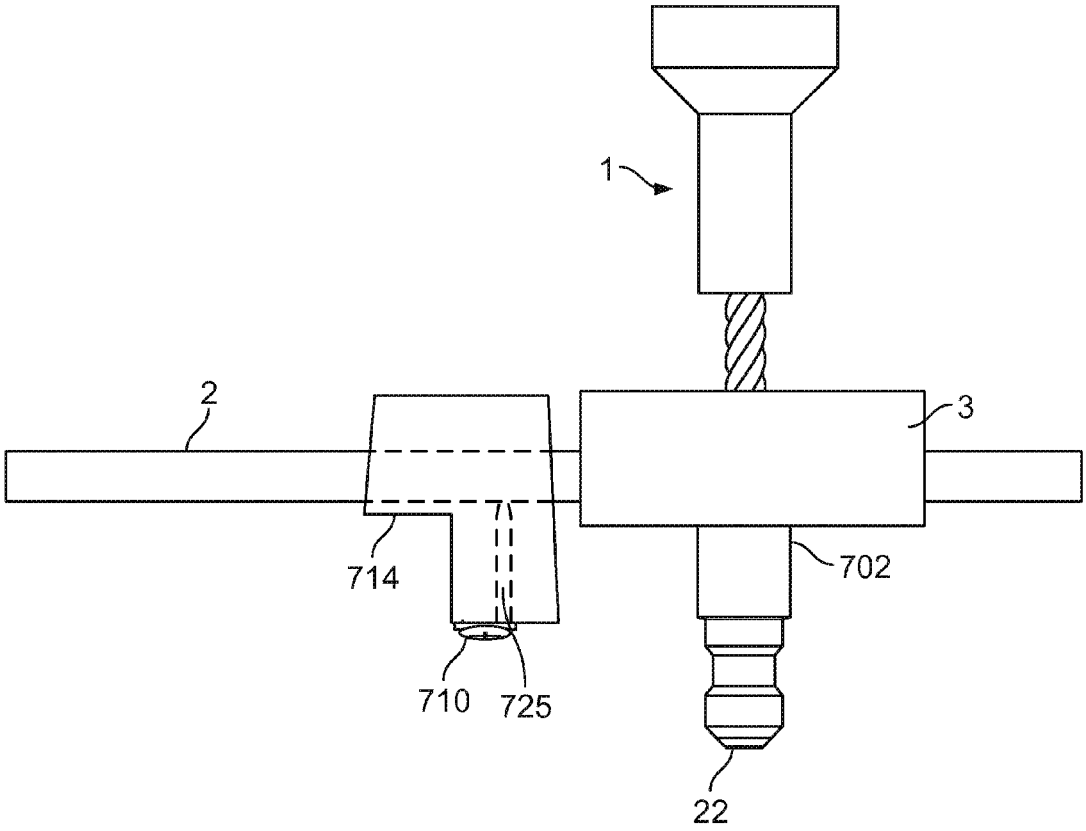
FIG. 24 is side view of a hybrid vertical shaft in a circuit with a contact block.
Figure 25:
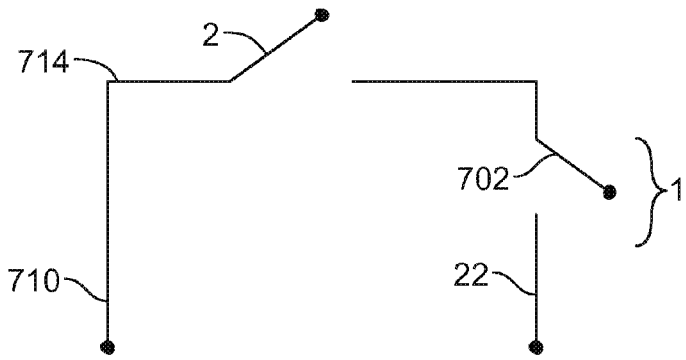
FIG. 25 is a circuit diagram.
Figure 26:
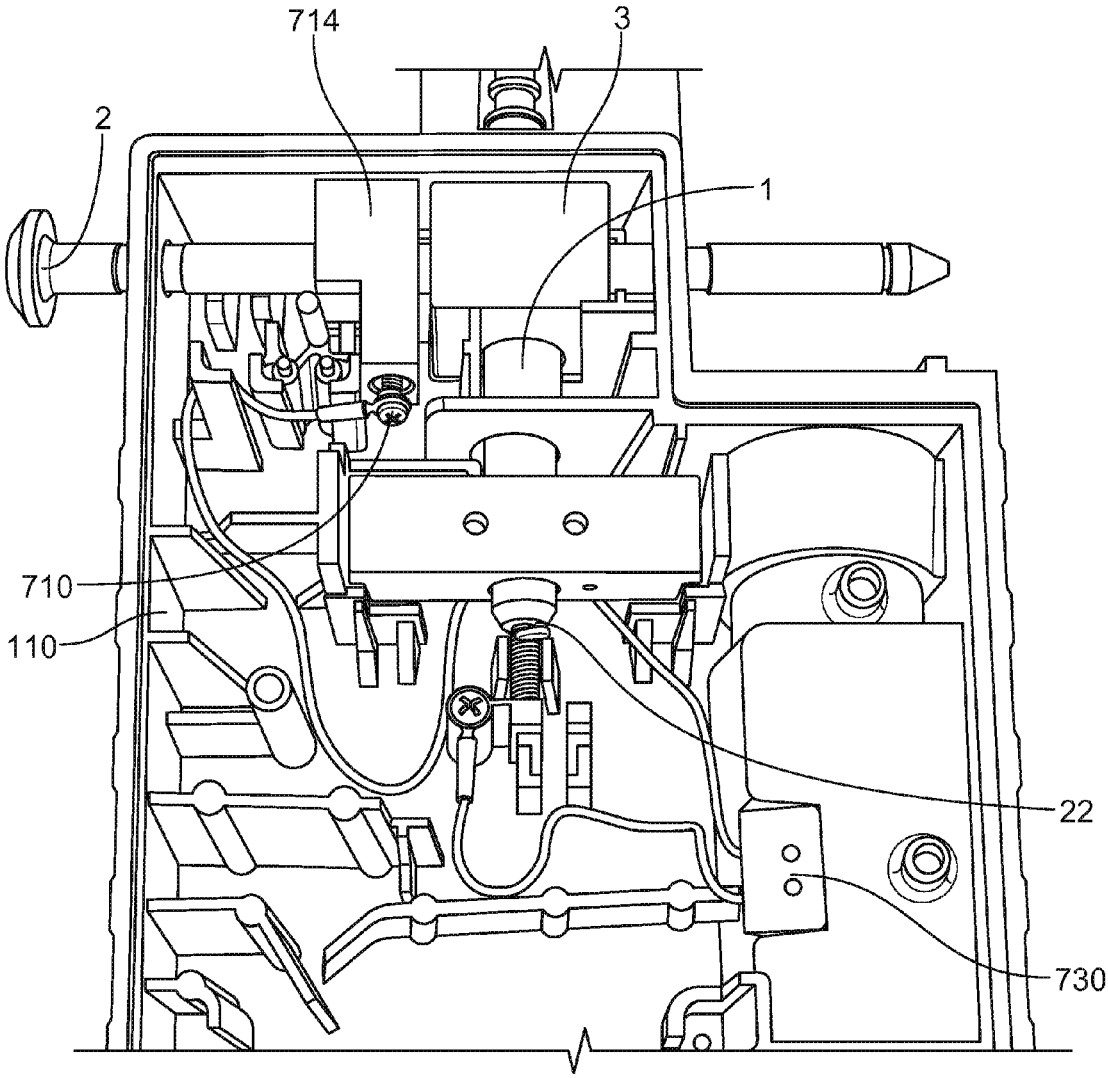
FIG. 26 is a partial plan view of the device having the internal portions exposed in the locking compartment.

Referring to FIG. 24, a vertical shaft 1 is shown held by a cross block 3 against a second shaft 2, which passes through a contact block 714. An electrical path is provided from a terminal 710 on the bottom of the contact block 714. From the terminal 710, electrically conductive material contacts the exterior 2 of the second shaft. The contact block 714 can either be formed entirely of the electrically conductive material or can include a portion that is formed entirely of the electrically conductive material. In some implementations, from the terminal 710, an electrically conductive plunger 725 contacts the exterior of the horizontal shaft 2. The optional conductive plunger 725 and portion of the horizontal shaft 2 that are within the contact block 714 are indicated in phantom in the figure. The electrically conductive horizontal shaft 2 contacts the electrically conductive exterior 702 of the vertical shaft 1. Although the hybrid vertical shaft (see FIG. 17) is shown in FIG. 24, the solid or non-flexible vertical shaft 1, as shown in FIG. 2, can alternatively be used. The vertical shaft 1 provides an electrical path from the exterior 702 through to the conductive end 22 of the shaft. FIG. 25 shows the equivalent circuit with the vertical shaft 1 and horizontal shaft 2 acting as switches to close the circuit for a secure seal or to open the circuit for a tampered seal. The contact block 714 may provide higher reliability than a switch component, e.g., as shown in FIG. 1, to sense the presence of the horizontal shaft 2. In some implementations there are stabilization plungers in the contact block 714 to securely hold in place the horizontal shaft 2. FIG. 26 shows a possible implementation with the electrical circuit brought down with wires to a connector 730 for monitoring by a circuit board.

Figure 10:
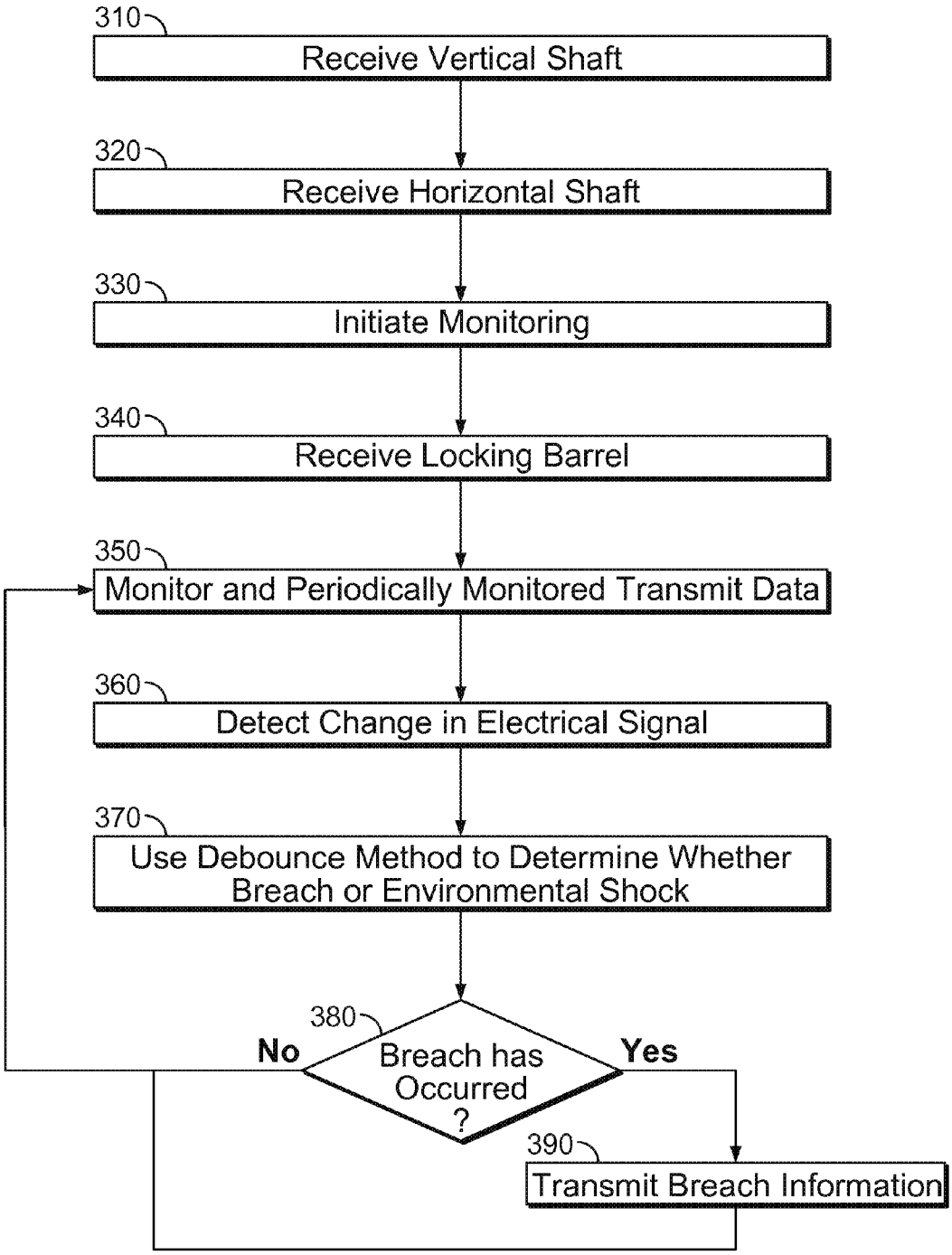
FIG. 10 is a flow diagram of steps performed by the device.

Referring to FIG. 10, the device can be used to secure a container to be shipped using the following method. A device that is ready for use has the vertical and horizontal shafts removed. A user inserts the vertical shaft through the locking mechanism or aperture of the container. The vertical shaft is then received by the device (step 310). Inserting the vertical shaft closes part of the circuit connected the circuit board. The sliding cover is in the closed position, that is, the connector is covered when the vertical shaft is inserted. Thus, when the vertical shaft is in place, the cover cannot be moved to the open position. Because the locking mechanism body, springs and inserts enable the automatic alignment of the vertical shaft to the cross block, the user need not hold the device in place once the vertical shaft is inserted. The user therefore has his or her hands free to insert the horizontal shaft.

The user inserts the horizontal shaft, which is received into the housing (step 320). Inserting the horizontal shaft locks the vertical shaft in place. Inserting the horizontal shaft also closes the micro switch, which closes the circuit. Alternatively, two or more separate circuits can be connected to the circuit board and logic can activate only if both are closed. Once the horizontal shaft is in place, the circuit is closed and the monitoring is initiated (step 330). The user then locks the locking barrel onto the end of the horizontal shaft, thus, the horizontal shaft receives the locking barrel (step 340).

The device is now ready to track the container and send messages to a receiver regarding the integrity of the device along with location information. The device can monitor and optionally send data packets on a periodic basis (step 350). In some implementations, the device determines that periodic monitoring is not necessary when a receiver or transmitter is not within range. However, when in range of a receiver, status information can be sent, such as one every hour, once every 20 minutes or more frequently, such as once every 5 minutes. The data can be sent, e.g., using a network, such as a GSM, 2G or 3G network. The device can also receive messages wirelessly. The device can continuously monitor security regardless of whether it is in range of communications or not. Event, GPS location and other data can be stored in memory for later retrieval. If a breach is detected when out of range of communications, the breach information is stored and is reported when the device comes into range of communications.

The electrical signal through the circuit can change during monitoring. This change in electrical signal is detected (step 360). The change in electric signal can be caused by an environmental shock or by a breach. An environmental shock can be any hard bounce or hit taken by the device that temporarily causes a short in the circuit, e.g., when the spring loses contact with the conductive portion of the shaft. A breach can occur when someone opens the device, either by removing one of the shafts or by cutting the vertical shaft, thereby opening the conductive loop of the circuit. The device can initiate a debouncing method to determine whether the change in electrical signal is a breach or a temporary short or opening caused by an environmental shock (step 370). The debouncing method determines when the short is for such an insignificant length of time that an actual breach has not occurred. Rather, the contacts were merely jiggled out of place for a moment. The system can check to determine whether a breach has occurred by changing the electrical signal sent through the circuit.

Figure 11:
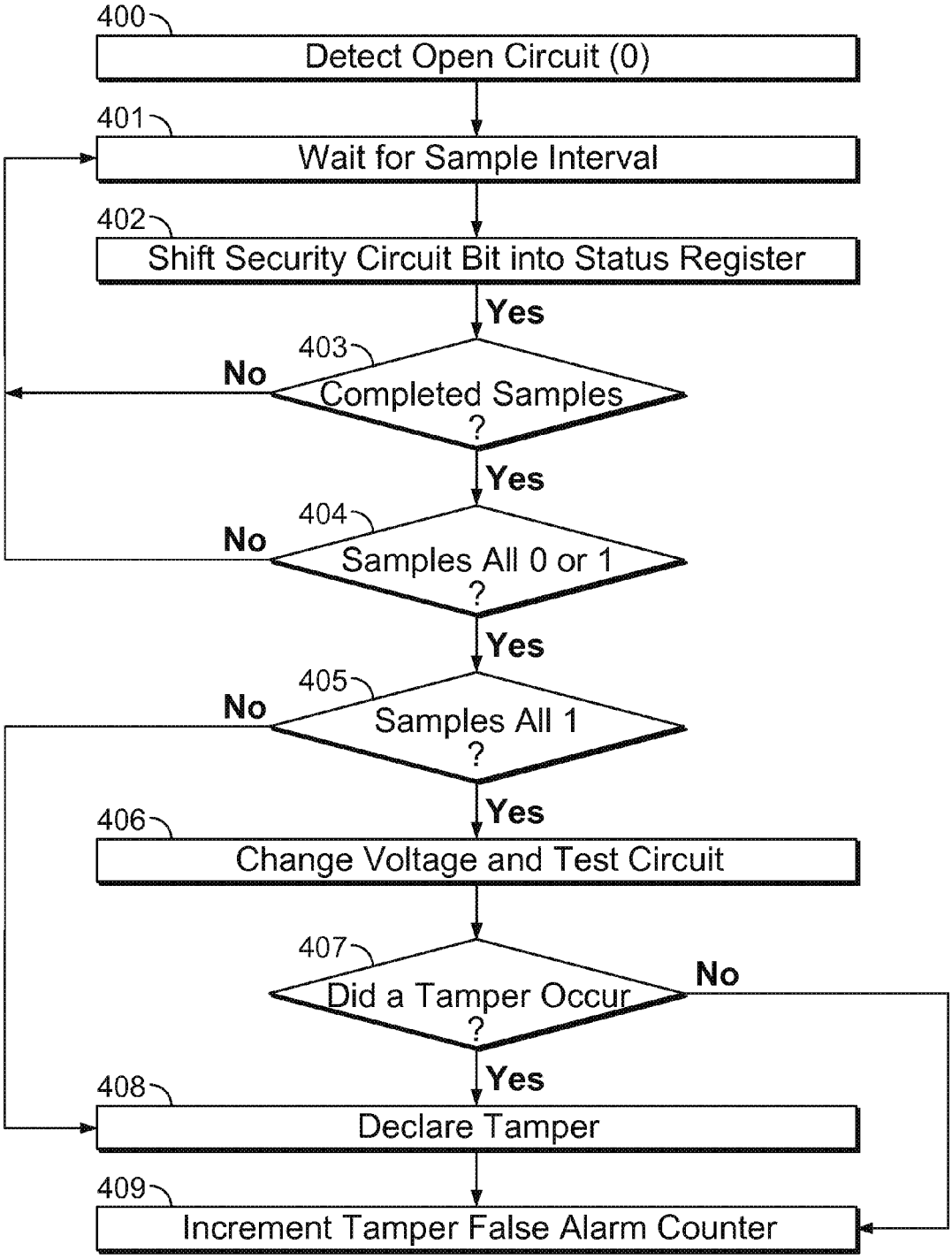
FIG. 11 is a flow diagram of a debounce method.
Figure 12:
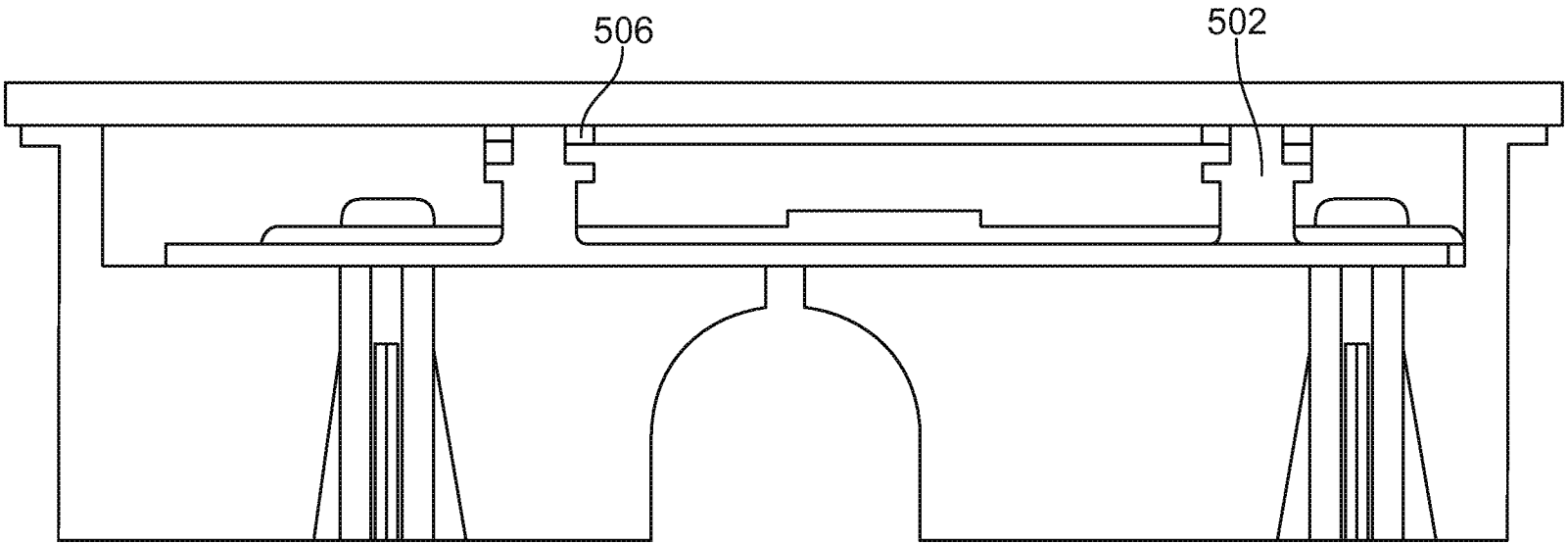
FIGS. 12 and 15 show a circuit board mounting mechanism.

Referring to FIG. 11, an exemplary debounce method can occur as follows. The secure state of the security circuit, or locked state, is represented by a closed electrical circuit or logic 1, with the non-secure state, i.e., an open state or breach, is represented by an open electrical circuit or logic 0. Once secured, a change from secure to non-secure causes an interrupt to a microprocessor, and an open circuit is detected (step 400). Upon the occurrence of the interrupt, the security state of 0 is shifted into a status register, the number of debouncing samples needed is set to the sample length and a debouncing loop is entered.

A wait is performed for the sample interval (step 401). After the wait, the state of the circuit is sampled, shifted as a bit into the sample register (step 402), then the number of samples taken are tested against the sample length to determine whether the samples are completed (step 403). If insufficient samples have been taken, then the sampling loop is repeated (step 401). When sufficient samples have been taken, the sample register is tested to determine whether the samples are all 1's or 0's, (step 404). If the sample register has not settled to a state of all 1's or all 0's, then the sampling loop (step 401) is repeated to take an additional sample, then retested for a settled state of all 1's or all 0's (step 404). Once a settled state has been measured in the sample register, the register is tested for all 1's, meaning secure (step 405). If the settled sample register is not all 1's, e.g., all 0's, then a tamper is declared (step 408).

If the settled sample register is all 1's, this indicates that a momentary tamper condition occurred, but the device has settled back to a secure condition, then the voltage through the security circuit is changed (step 406) for the purpose of testing for a splice attempt. Following the voltage change, the continuity of the security circuit is tested (step 407), with a secure status indicating that a tamper false alarm has been detected (step 409). A counter of tamper false alarms can be incremented. If the security circuit continuity check following the voltage change fails, then a tamper attempt using a splice has been detected. A tamper is declared (step 408).

Referring back to FIG. 10, if it is determined that a breach has occurred (step 380), the device transmits data regarding the breach, such as the occurrence itself, the time of the occurrence and the location, to a data collector (step 390). The location and tamper time can also be recorded in the device, such as for later download. In some instances, the data regarding the breach is immediately transmitted. "Immediately" may mean within 2 minutes, such as within 30 seconds. In some implementations, the breach data is transmitted once the device is within range of a receiver capable of receiving the data. In some implementations, an external signal on the device is changed to indicate the tamper. For example, a light, such as a red LED light may be lit.

Once the device arrives at a destination, a receiver or an authority can use the device to determine whether the container has been tampered with or breached. A first inspection is a visual inspection of the exterior of the device. The inspector will easily be able to determine whether the security status has detected a breach by observing the state of the LED indicators. The inspector can in addition determine if the device itself has been tampered with by observing whether the device has been drilled into, cut, or otherwise opened. As there are no user accessible screws or opening mechanisms, access to the internals of the device leaves an indication of such tampering. Upon completing the inspection, the horizontal shaft may be cut and the horizontal and vertical shafts removed to remove the device for reuse. The vertical shaft is reusable and the horizontal shaft and locking barrel are inexpensive consumable parts which can be replaced when the device is put back into service.

A number of implementations have been described. Nevertheless, it will be understood that various modifications may be made without departing from the spirit and scope of the disclosure. For example, although a vertical shaft and a horizontal shaft are discussed above, these shafts could be angularly offset at other than a right angle. For example, steps can be performed in a different order. Accordingly, other implementations are within the scope of the following claims.

We claim:

1. A security device, comprising:

a housing;

a first shaft and a second shaft, wherein when the first shaft and the second shaft are within the housing, only a first end of the first shaft extends outside of the housing, a first end and a second end of the second shaft are outside of the housing, the second shaft locks the first shaft in the housing, the second shaft is transverse to the first shaft and the first shaft is configured as a conductive path; and an electrical circuit within the housing, wherein the conductive path is in electrical communication with the circuit when the first shaft is in the housing and removing the first shaft from the housing opens the electrical circuit.

2. The device of claim 1, further comprising a block within the housing, the block having a first aperture and a second aperture, wherein when the first shaft and second shaft are within the housing, the first shaft is within the first aperture of the block and the second shaft is within the second aperture of the block, the second shaft and block together lock the first shaft in the housing.

3. The device of claim 2, wherein the first shaft is perpendicular to the second shaft within the block.

4. The device of claim 3, wherein the first aperture in the block intersects the second aperture.

5. The device of claim 3, wherein the first shaft includes a groove and the second shaft locks the first shaft by resting within the groove.

6. The device of claim 1, further comprising a block within the housing, the block having an aperture and a recess, wherein when the first shaft and second shaft are within the housing, the first shaft is within the aperture of the block and the second shaft is within the recess of the block, the second shaft and block together lock the first shaft in the housing.

7. The device of claim 6, wherein the first shaft is perpendicular to the second shaft within the block.

8. The device of claim 7, wherein the aperture in the block intersects the recess.

9. The device of claim 7, wherein the first shaft includes a groove and the second shaft locks the first shaft by resting within the groove.

10. The device of claim 1, wherein the first shaft has a conductive body, an insulated conductor extending down a length of the conductive body, and a conductive bridging component in the first end, the conductive body, conductive bridging component and insulated conductor forming the conductive path.

11. The device of claim 10, wherein:

a tip of the first shaft at an opposite end of the first shaft from the first end makes electrical contact with the circuit; and between the tip of the first shaft and the conductive body is an electrically insulating portion that insulates the tip from the conductive body.

12. The device of claim 11, wherein:

the circuit includes a spring; and the spring is in direct contact with the tip of the first shaft.

13. The device of claim 1, further comprising:

a cover covering a chamber in the housing, the cover including an aperture, wherein the first shaft extends through the aperture of the cover, maintaining the cover over the chamber so that the chamber is closed, wherein removal of the first shaft from the housing permits the cover to be moved so that the chamber is open to an environment outside of the housing.

14. The device of claim 13, wherein the chamber when closed is not hermetically sealed.

15. The device of claim 13, further comprising a connector, wherein the connector is within the chamber and can only be physically connected to when the chamber is open.

16. The device of claim 1, further comprising a locking barrel on the second shaft, wherein the locking barrel prevents the second shaft from being removed from the housing without physically breaking the second shaft or the housing.

17. The device of claim 1, wherein the second shaft includes a notch.

18. The device of claim 1, wherein housing includes an internal baffle and a drainage aperture fluidly connecting an exterior of the housing to an interior of the housing.

19. The device of claim 18, wherein the internal baffle and housing together surround the drainage aperture by at least 90%.

20. The device of claim 18, wherein the first shaft enters the housing at a top of the housing, the second shaft enters the housing at a side of the housing, the internal baffle has a first end directly adjacent to the side of the housing and a second end, wherein the first end is closer to the top of the housing than the second end.

21. The device of claim 18, wherein the baffle extends entirely from a front side to a back side of an interior of the housing.

22. The device of claim 1, wherein the circuit comprises a mechanical switch, the second shaft positioned to activate the mechanical switch so that the circuit at the mechanical switch is closed when the second shaft is in the housing.

23. The device of claim 1, wherein the circuit comprises a contact block that is electrically conductive, the contact block forming an electrical connection to the second shaft, the second shaft also being electrically conductive so that the circuit between the first shaft and the contact block is closed when the second shaft is in the housing.

24. The device of claim 1, further comprising a locking mechanism, wherein the locking mechanism is configured to secure the first shaft within the housing such that the first shaft can be removed from the housing with an application of force greater than the force of gravity on the first shaft.

25. The device of claim 24, wherein the locking mechanism is spring loaded.

26. The device of claim 24, wherein the locking mechanism provides a ground connection for the circuit.

27. The device of claim 1, wherein the housing forms a locking chamber and a separate electronics chamber.

28. The device of claim 27, further comprising a circuit board within the electronics chamber.

29. The device of claim 28, further comprising shock absorbing materials between the circuit board and the housing.

30. The device of claim 29, wherein the electronics chamber is water tight to at least 15 centimeters of depth.

31. The device of claim 28, further comprising a global positioning system.

32. The device of claim 28, further comprising a transmitter.

33. The device of claim 1, wherein the housing lacks any mechanical fasteners to hold the housing closed.

34. The device of claim 1, wherein an entirety of the first shaft is rigid.

35. The device of claim 1, wherein a portion of the first shaft is flexible.

36. The device of claim 35, wherein the first shaft is less than 175 mm long.

37. The device of claim 1, wherein:

the first end of the first shaft is connected to a flexible portion; and the housing includes a first aperture for receiving a second end of the first shaft and a second aperture for receiving the flexible portion.

38. The device of claim 1, wherein the housing contains an inverse incline mechanism for securing the flexible portion within the housing.

39. The device of claim 1, wherein:

the second shaft includes an aperture, wherein the main axis of the aperture is perpendicular to a main axis of the second shaft; and a seal is secured within the aperture, the seal preventing the second shaft from being removed from the housing without breaking or breaching the seal or the second shaft.

40. A method of securing a container, comprising:

receiving a first shaft in a housing containing an electrical circuit, wherein inserting the first shaft into the housing closes a part of an electrical circuit within the housing and receiving the first shaft attaches the housing to the container;

after receiving the first shaft, receiving a second shaft in the housing, wherein the second shaft locks the first shaft in the housing and wherein the second shaft is transverse to the first shaft; and initiating monitoring of a location of the device and a signal through the circuit.

41. The method of claim 40, wherein receiving the first shaft includes receiving a conductive path.

42. The method of claim 40, wherein receiving the first shaft and receiving the second shaft both include receiving the first shaft and the second shaft in a block that is configured to hold the first shaft adjacent to the second shaft.

43. The method of claim 42, wherein the block is configured to hold the first shaft perpendicular to the second shaft.

44. The method of claim 40, further comprising:

receiving a mechanical shock; and maintaining an electrical connection between the first shaft and the circuit with a shock absorbing spring within the circuit.

45. The method of claim 40, further comprising:

receiving a mechanical shock; and determining a temporary change in electrical conduction by the circuit.

46. The method of claim 40, further comprising:

determining a change in electrical conduction by the circuit; and determining whether the temporary change in electrical conduction is either a breach or an environment shock.

47. The method of claim 46, wherein determining includes using a debouncing method.

48. The method of claim 46, wherein the determining results in a determination that a breach has occurred and in response to determining that a breach has occurred, communicating data regarding the breach to a receiver outside of the housing.

49. The method of claim 48, wherein the communicating occurs within 2 minutes of the breach.

50. The method of claim 40, wherein receiving the first shaft includes locking a slidable cover in a closed position.

51. The method of claim 40, further comprising receiving a locking barrel on the second shaft.

52. The method of claim 40, wherein receiving the second shaft closes the circuit by providing an electrically conductive path between the first shaft and a contact block that electrically contacts the second shaft.

53. The method of claim 40, wherein receiving the second shaft closes a switch in the circuit.

54. The method of claim 40, wherein receiving the first shaft includes holding the first shaft with spring tension against an electrical component of the circuit.

55. The method of claim 54, wherein holding the first shaft with spring tension provides sufficient force to hold the first shaft within the housing without applying additional external force to the housing.

56. A method of securing a device, comprising:

inserting a first shaft in a housing containing an electrical circuit, wherein inserting the first shaft into the housing closes a part of an electrical circuit within the housing and receiving the first shaft attaches the housing to the container;

after inserting the first shaft, inserting a second shaft in the housing, wherein the second shaft locks the first shaft in the housing, wherein the second shaft is transverse to the first shaft and inserting the first shaft and second shaft initiates monitoring of a location of the device and an electronic signal through the circuit.

57. The method of claim 56, further comprising:

breaking the second shaft and removing the second shaft from the housing;

after removing the second shaft from the housing, removing the first shaft from the housing;

sliding a cover to an open position to expose a connector, wherein the cover is locked in the housing when the first shaft is in the housing and the connector cannot by physically accessed when the cover is not in the open position; and connecting to the connector and downloading data from the device.

* * * * *